US010732539B2

(12) United States Patent
Katayama et al.

(10) Patent No.: US 10,732,539 B2
(45) Date of Patent: Aug. 4, 2020

(54) IMAGE FORMING APPARATUS

(71) Applicant: CANON KABUSHIKI KAISHA, Tokyo (JP)

(72) Inventors: Hiromasa Katayama, Tokyo (JP); Yohei Gamo, Abiko (JP); Shogo Yamasaki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/111,537

(22) Filed: Aug. 24, 2018

(65) Prior Publication Data

US 2019/0064696 A1 Feb. 28, 2019

(30) Foreign Application Priority Data

Aug. 28, 2017 (JP) ..... 2017-163430

(51) Int. Cl.
*G03G 15/08* (2006.01)
*G03G 15/16* (2006.01)

(52) U.S. Cl.
CPC ..... *G03G 15/0812* (2013.01); *G03G 15/087* (2013.01); *G03G 15/0872* (2013.01); *G03G 15/0886* (2013.01); *G03G 15/1615* (2013.01); *G03G 2221/1654* (2013.01); *G03G 2221/1807* (2013.01)

(58) Field of Classification Search
CPC ..... G03G 15/057; G03G 15/0867; G03G 15/0872; G03G 15/0877; G03G 15/0886; G03G 15/0898; G03G 21/1842; G03G 2215/0665; G03G 2215/0668; G03G 2215/0678
USPC ..... 399/107, 110, 119, 120, 252, 258, 260, 399/262
See application file for complete search history.

(56) References Cited

U.S. PATENT DOCUMENTS 6,289,193 B1 * 9/2001 Ban ..... G03G 15/0882 399/258
6,839,533 B2 * 1/2005 Ban ..... G03G 15/0877 399/120
7,174,120 B2 * 2/2007 Koyama ..... G03G 15/0868 399/258

(Continued)

FOREIGN PATENT DOCUMENTS

EP 2 924 511 A1 9/2015
JP 2015-049291 A 3/2015

OTHER PUBLICATIONS

European Search Report dated Jan. 31, 2019, in related European Patent Application No. 18189467.6.

*Primary Examiner* — Hoan H Tran
(74) *Attorney, Agent, or Firm* — Venable LLP

(57) ABSTRACT

An image forming apparatus including a rotatable developer container, a receiving device which receives the container and is inserted in a direction along a rotational axis of the container and which receives the developer discharged from the container when the container is in a first position, and a regulating member provided on the container. The regulating member prevents, during transportation of the image forming apparatus, the container from moving to the first position from a second position which is upstream of the first position with respect to an inserting direction of the container and in which the developer is not discharged from the container.

24 Claims, 28 Drawing Sheets

(56) References Cited

U.S. PATENT DOCUMENTS

| | | | | |
|---|---|---|---|---|
| 7,400,848 | B2 * | 7/2008 | Kimura | G03G 15/0868 399/262 |
| 7,412,192 | B2 * | 8/2008 | Nakajima | G03G 15/0886 399/262 |
| 7,555,250 | B2 * | 6/2009 | Nagae | G03G 15/0875 399/260 |
| 8,693,925 | B2 * | 4/2014 | Horii | G03G 15/0875 222/DIG. 1 |
| 9,360,797 | B1 * | 6/2016 | Bayubay | G03G 15/0863 |
| 9,395,649 | B1 * | 7/2016 | Kanno | G03G 15/0877 |
| 9,405,221 | B2 * | 8/2016 | Komatsu | G03G 15/0868 |
| 9,423,720 | B2 * | 8/2016 | Hosokawa | G03G 15/0884 |
| 9,671,748 | B2 | 6/2017 | Kobayashi et al. | |
| 2010/0215395 | A1 | 8/2010 | Funada et al. | |
| 2016/0170371 | A1 | 6/2016 | Kubo | |
| 2017/0075256 | A1 | 3/2017 | Eto | |
| 2017/0261924 | A1 | 9/2017 | Kobayashi et al. | |
| 2018/0164714 | A1 | 6/2018 | Takahashi et al. | |

* cited by examiner (a)

(b)

(a)

(b)

(a)

(b)

(c)

(a)

(b)

(a)

(b)

(a)

(b)

(c)

(a)

(b)

(a)

(b)

(a)

(b)

(a)

(b)

(a)

(b)

(a)

(b)

IMAGE FORMING APPARATUS

FIELD OF THE INVENTION AND RELATED ART

The present invention relates to an image forming apparatus such as a copying machine, a printer, a facsimile machine, and a multifunction machine having the functions of these machines.

An image forming apparatus is known in which the container containing the developer can be dismountably mounted to the main assembly of the device, and in the mounted state thereof, the developer can be replenished to the developing device from the accommodating container provided inside the main assembly of the device. A structure has been proposed in Japanese Laid-open Patent Application No. 2015-49291, for example, in which a shutter of the accommodating container does not open even in a state where the accommodating container is mounted to a predetermined mounting position of the apparatus main assembly, and the shutter opens in accordance with the start of driving of the container. In the case of the structure described in this publication, the shutter is not opened even if the container is mounted, and therefore, even if the image forming apparatus is transported in a state where the accommodating container is mounted to the apparatus main assembly (single (same) package transportation), leakage of the developer is suppressed.

However, since the accommodating container is constituted to be mounted to and dismounted from the main assembly of the apparatus, it is often mounted without being fastened and fixed to the main assembly of the apparatus. There is a possibility that when the image forming apparatus is transported, the accommodating container vibrates, with the result that loads are applied to various parts connected or in contact between the mounted accommodating container and the device main assembly.

An object of the present invention is to provide a structure in which it is possible to prevent loads from being applied to various parts connected between the mounted accommodating container and the apparatus main assembly when transporting the image forming apparatus.

SUMMARY OF THE INVENTION

The object of the present invention is to provide a structure in which the load between the mounted accommodating container and the apparatus main assembly is reduced, even if the image forming apparatus is transported while the accommodating container is mounted to the image forming apparatus.

According to an aspect of the present invention, there is provided an image forming apparatus comprising a rotatable accommodating container configured to accommodate a developer; a receiving device which is configured to receive said accommodating container which is inserted in a direction along a rotational axis of said accommodating container and which is configured to receive the developer discharged from said accommodating container when said accommodating container is in a first position; and a regulating member provided on said accommodating container, said regulating member being configured to prevent, during transportation of said image forming apparatus, said accommodating container from moving to the first position from a second position which is upstream of the first position with respect to an inserting direction of said accommodating container and in which the developer is not discharged from said accommodating container.

Further features of the present invention will be described from the following description of the example description with reference to the attached drawings.

BRIEF DESCRIPTION OF THE DRAWINGS

FIG. 13 is a side view in a state where the accommodating container is placed in the apparatus main assembly, and part (a) shows the upstream end with respect to the inserting direction, and part (b) shows the downstream end with respect to the inserting direction in Embodiment 1.

Figure 26:
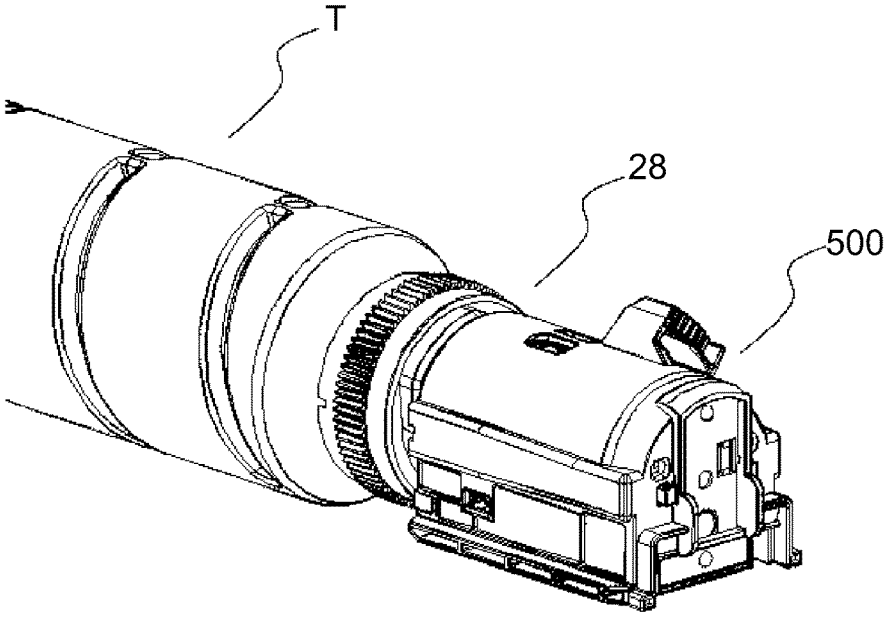
Figure 26:
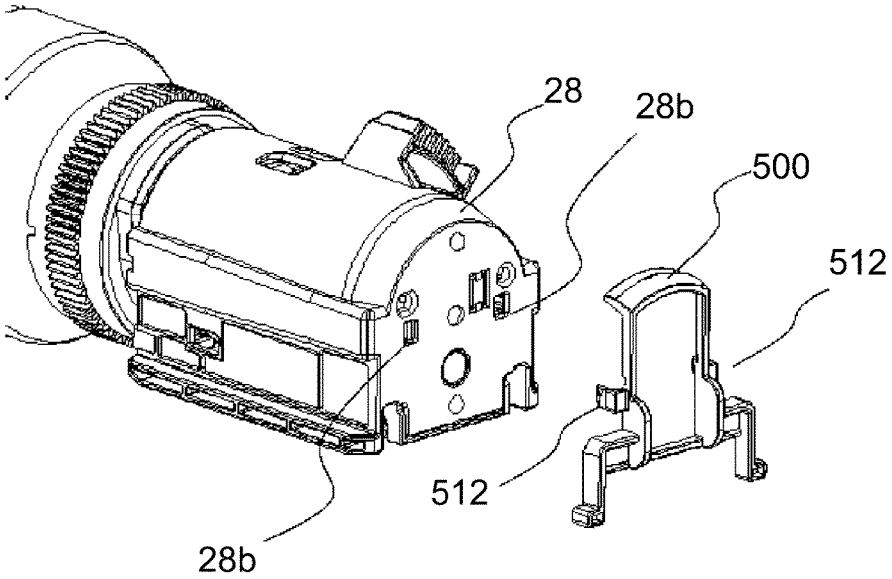

Parts (a) and (b) of FIG. 26 are perspective views showing mounting of the regulating member according to Embodiment 4 of the present invention.

Figure 27:
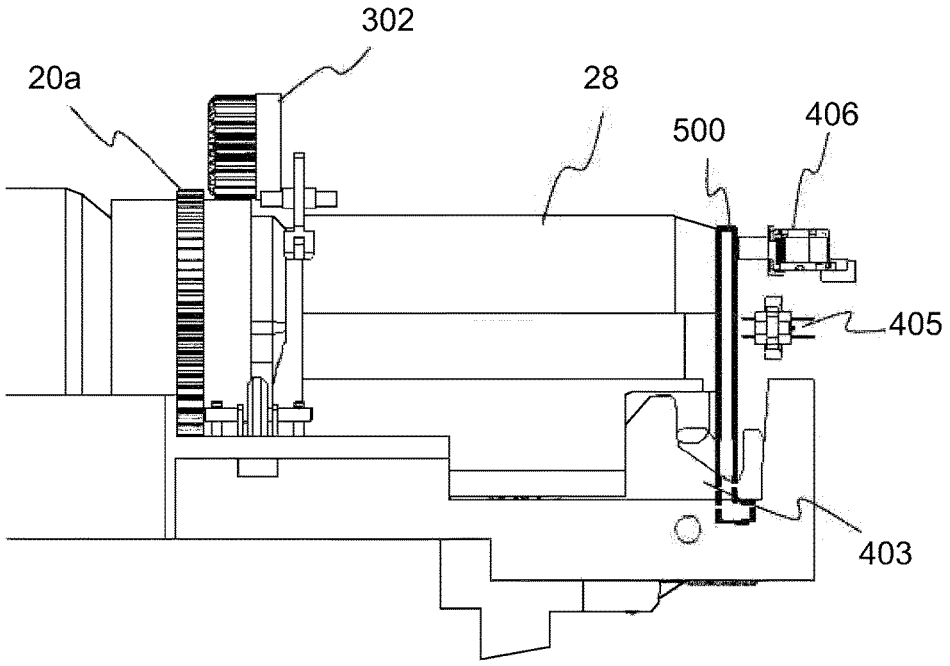
Figure 27:
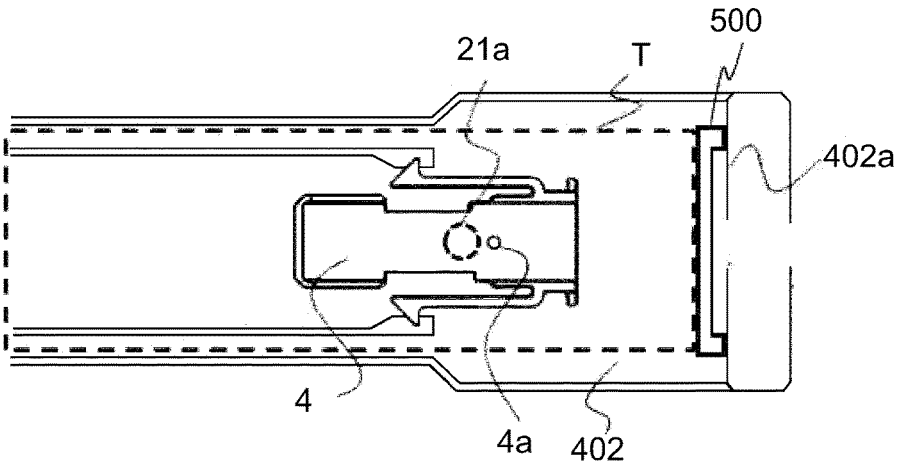

Parts (a) and (b) of FIG. 27 are side views of the toner accommodating container packaged at the back side according to Embodiment 4 of the present invention.

Figure 28:
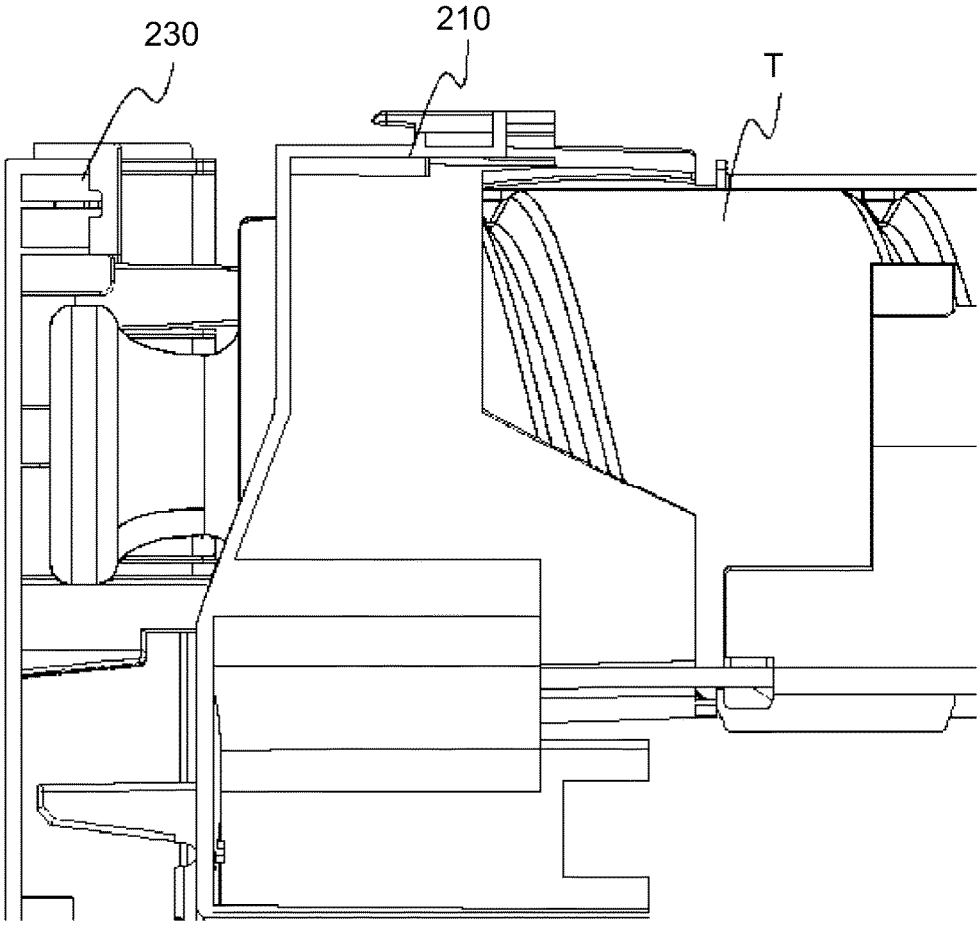

FIG. 28 is a side view of the toner accommodating container packaged at the front side according to Embodiment 4 of the present invention.

Figure 29:
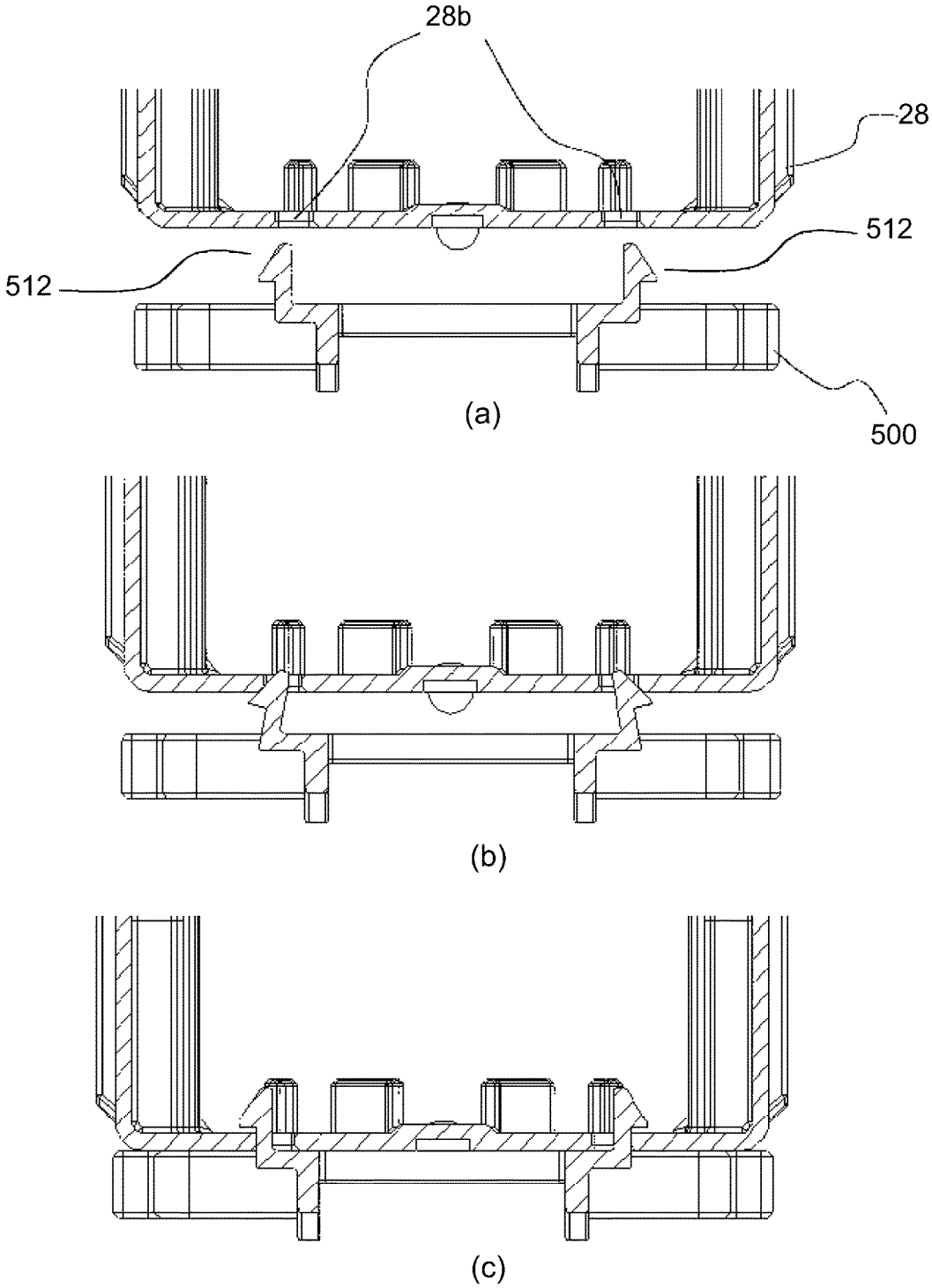

Parts (a), (b) and (c) of FIG. 29 are sectional views showing the mounting of the regulating member in Embodiment 4 of the present invention.

Figure 30:
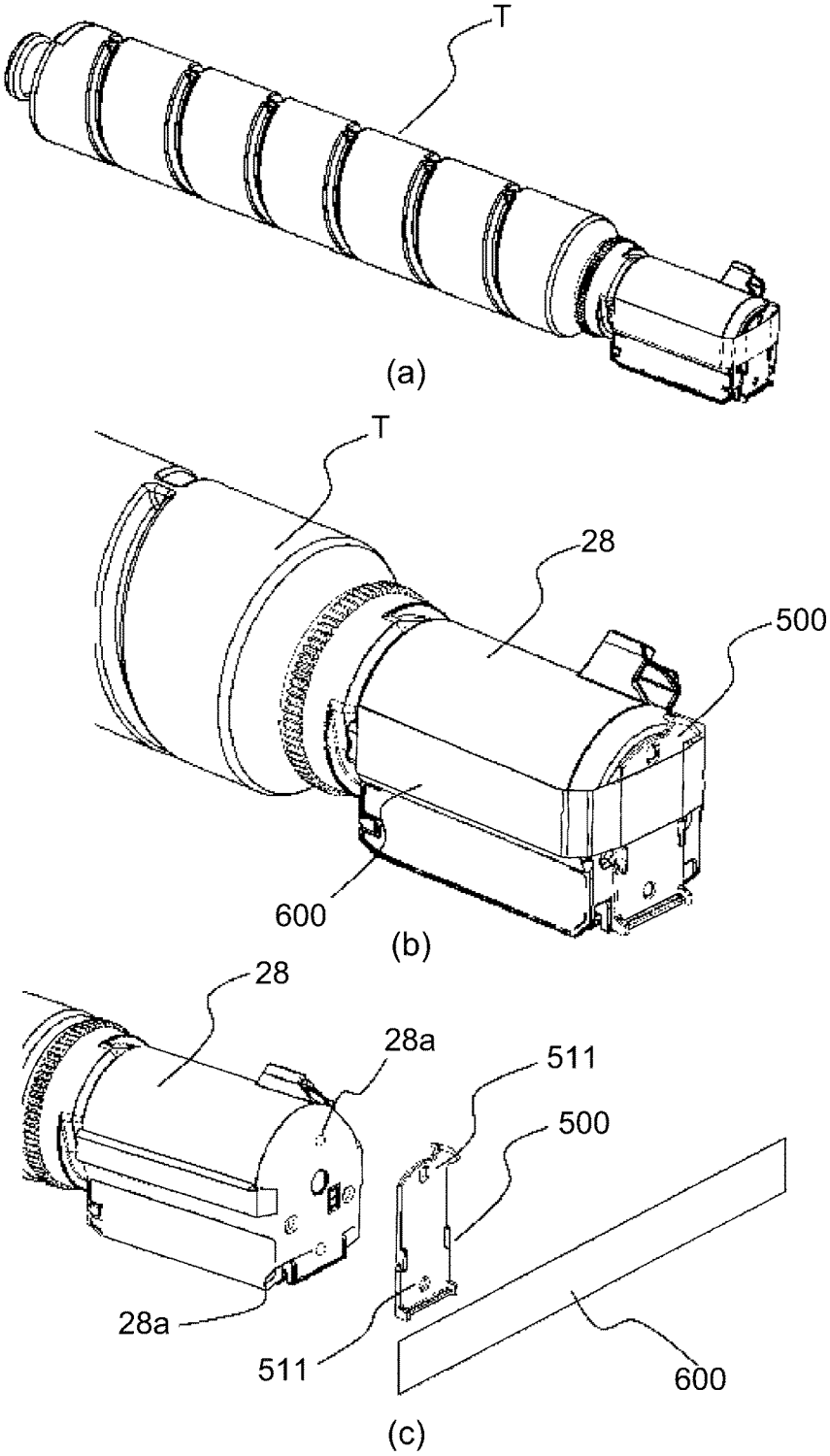

Parts (a), (b) and (c) of FIG. 30 are perspective views showing the mounting of the regulating member in Embodiment 5 of the present invention.

DESCRIPTION OF THE EMBODIMENTS

Embodiment 1

Referring to FIGS. 1 to 16, an Embodiment 1 will be described. First, a schematic structure of the image forming apparatus of this embodiment will be described referring to FIG. 1.

[Image Forming Apparatus]

The image forming apparatus 200 is a color image forming apparatus using an electrophotographic process, and is an image forming apparatus of a so-called intermediary transfer tandem type in which four color image forming stations Pa to Pd are provided above the intermediary transfer belt 7 side by side. In this embodiment, the image forming apparatus 200 forms an image with four colors of yellow (Y), magenta (M), cyan (C), and black (Bk). The number of colors is not limited to four, and the order of colors is not limited to this.

The image forming apparatus 200 forms a toner image (image) on the recording material S, in accordance with an image signal from an original reading device (not shown) connected to the apparatus main assembly 200A or a host device such as a personal computer which is communicably connected to the apparatus main assembly 200A. As a recording material, a sheet material such as paper, plastic film, cloth or the like is used.

The recording material S is stored so as to be stacked in the storage case 10 and is fed in accordance with the image formation timing by a feeding roller 61 using a friction separation method. The recording material S fed by the feeding roller 61 passes through the feeding path and is fed to registration rollers 62. Oblique feeding correction and timing correcting operations for the recording material S are carried out by the registration rollers 62, and thereafter, the recording material S is fed to the secondary transfer portion T2. The secondary transfer portion T2 is a transfer nip portion formed by the secondary transfer outer roller 9 and the secondary transfer inner roller 8 opposed thereto, and it secondarily transfers the toner image from the intermediary transfer belt 7 onto the recording material S by applying a predetermined pressure and electrostatic bias.

The description will be made as to the image forming process of the toner image to be fed to the secondary transfer portion T2 in synchronism with the feeding process of the recording material S up to the secondary transfer portion T2 explained above. The image forming portions Pa to Pd include respective photosensitive drums 1*a* to 1*d* in the form of cylindrical photosensitive members as image bearing members, respective charging devices 2*a* to 2*d*, respective exposure devices 3*a* to 3*d*, respective developing devices 100*a* to 100*d*, respective primary transfer rollers 5*a* to 5*d*, respective drum cleaners 6*a* to 6*d*, and the like.

First, the surfaces of the photosensitive drums 1*a* to 1*d* which are rotationally driven in the direction of the arrow by a driving device (not shown) are uniformly charged by the charging devices 2*a* to 2*d*. Then, the exposure devices 3*a* to 3*d* are driven based on the image information signal (image signal) fed from the original reading apparatus or the like, and the laser beam passes through the deflection member such as a mirror to the photosensitive drums 1*a* to 1*d*. By this, electrostatic images corresponding to the respective colors are formed on the photosensitive drums 1*a* to 1*d*. Next, the electrostatic images formed on the photosensitive drums 1*a* to 1*d* are developed with toner by the developing devices 100*a* to 100*d*.

The developing devices 100*a* to 100*d* include developing containers 101*a* to 101*d* for containing developer, developing sleeves 102*a* to 102*d* as developer carrying members, and the like. The developing sleeves 102*a* to 102*d* carry the developer in the developing containers 101*a* to 101*d* to the developing regions opposed to the photosensitive drums 1*a* to 1*d*. The developing sleeves 102*a* to 102*d* supply the toner onto the photosensitive drums 1*a* to 1*d* by applying a predetermined developing bias to develop the electrostatic image. In this embodiment, the developer is a two-component developer containing non-magnetic toner and magnetic carrier. However, the developer may be a one-component developer including toner.

After the toner images are formed on the photosensitive drums 1*a* to 1*d*, predetermined pressing force and electrostatic load bias are applied by the primary transfer rollers 5*a* to 5*d* at the primary transfer portions T1*a* to T1*d*. By this, the toner images on the photosensitive drums 1*a*-1*d* are primarily transferred onto the intermediary transfer belt 7. Transfer residual toner left on the photosensitive drums 1*a* to 1*d* is collected by the drum cleaners 6*a* to 6*d* and the photosensitive drums 1*a* to 1*d* prepare for the next image forming process again.

By the above-described image forming operation, the toners in the developing containers 101*a* to 101*d* of the developing devices 100*a* to 100*d* are consumed. When the amount of toner in the developing containers 101*a* to 101*d* decreases, the toner is supplied to the developing containers 101*a* to 101*d* from the accommodating containers Ta to Td. For this purpose, a supplying pipe 70 for supplying toner is provided between the containers Ta to Td and the developing containers 101*a* to 101*d*. Details of such a toner supplying operation will be described later.

The intermediary transfer belt 7 is an endless belt, and is provided on an intermediary transfer belt frame (not shown). It is stretched by a secondary transfer inner roller 8 which also serves as a rotational driving of the intermediary transfer belt 7, a tension roller 17, and a secondary transfer upstream roller 18. When the secondary transfer inner roller 8 is rotationally driven in the direction of the arrow R1, the intermediary transfer belt 7 is rotationally driven in the direction of the arrow R2.

The image forming process described above is executed in parallel by the image forming portions Pa to Pd of Y, M, C and Bk, and the downstream toner image is sequentially transferred superimposedly onto the toner image primarily transferred onto the intermediary transfer belt 7. By this, a full-color toner image is formed on the intermediary transfer belt 7 and fed to the secondary transfer portion T2. The untransferred residual toner remaining on the intermediary transfer belt 7 after passing through the secondary transfer portion T2 is collected by the belt cleaner device 11.

By the above-described conveyance process and image forming process, the secondary transfer is carried out in timed relation with the feeding of the recording material S such that the full color toner image is matched at the secondary transfer portion T2. After that, the recording material S is fed to the fixing device 13. The fixing device 13 has a fixing roller 14 including a heater therein and a facing roller 15 facing the fixing roller 14 and forming a fixing nip portion. The recording material S fed into the fixing device 13 passes through the inside of the fixing nip portion and a predetermined pressure and heat quantity are applied in the fixing nip portion. Then, the toner image is melted and fixed (fixed) on the recording material S. The recording material S to which the toner image is fixed is discharged to the discharge tray 63.

Each process as described above is controlled by the control portion 50. The control portion 50 has a CPU (Central Processing Unit), a ROM (Read Only Memory), and a RAM (Random Access Memory). The CPU controls each part while reading the program corresponding to the control procedure stored in the ROM. Working data and inputted data are stored in the RAM, and the CPU performs control by referring to the data stored in the RAM based on the aforementioned programs and the like. In addition, the image forming apparatus 200 has an operation portion 60 such as an operation panel, and the user can make various settings of the image forming apparatus 200 through the operation portion 60.

[Storage Container]

Next, referring to FIGS. 2 and 3, the containers Ta to Td containing the toner will be described. Since the containers Ta to Td have the same structure for each container, the container Ta will be described below as a representative.

Figure 2:
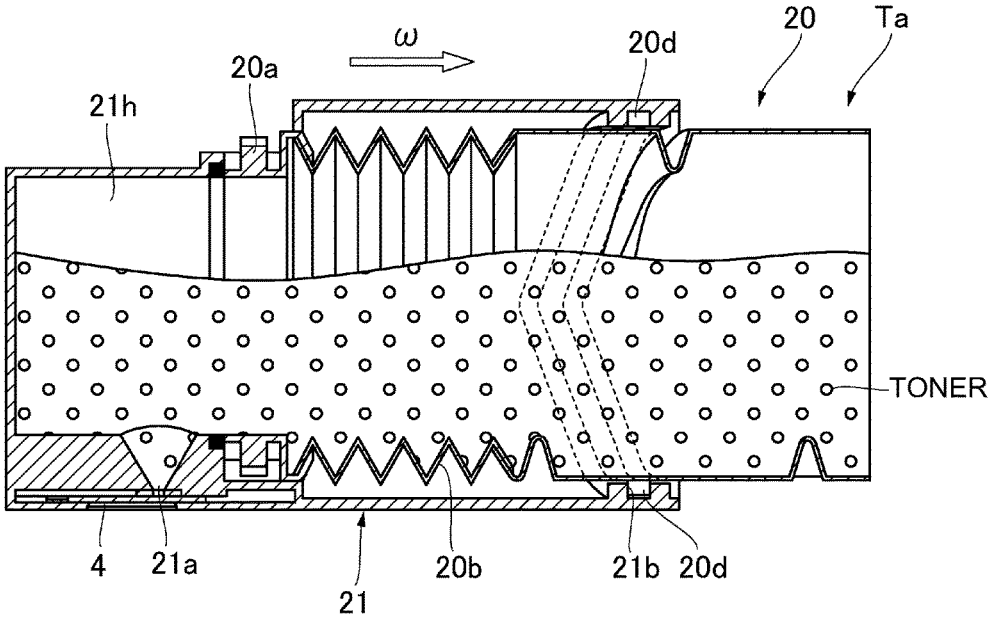
In FIG. 2, part (a) is a sectional view of the accommodating container when a volume of the pump part is increased, and part (b) is a sectional view of the accommodating container when the volume of the pump part is reduced in Embodiment 1.
Figure 2:
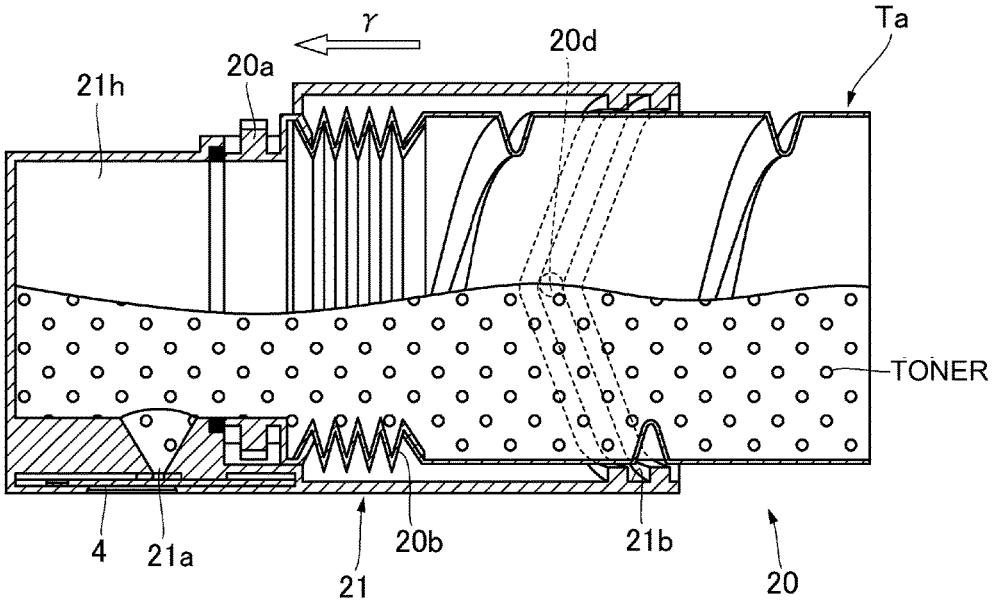

As shown in part (a) and part (b) of FIG. 2, the accommodating container Ta is formed in a hollow cylindrical shape and has a toner storage part 20 including an internal space for accommodating toner. In addition, the containing container Ta has the flange portion 21 on one end side in the longitudinal direction (toner feeding direction) of the toner containing portion 20. The toner container 20 can rotate relative to the flange 21. The flange portion 21 is provided with a discharge portion 21*h* including a hollow shape for temporarily storing the toner transported from the inside of the toner storing portion 20. In the bottom of the discharge portion 21*h*, a discharge opening 21*a* for discharging the toner to the outside of the accommodating container Ta, that is, a supply opening for supplying toner to the development devices 100*a* to 100*d* is provided. A shutter 4 for opening and closing the discharge opening 21*a* is provided inside the flange portion 21. The details of the operation of the shutter 4 will be described hereinafter.

A gear portion 20*a*, a pump portion 20*b*, a projecting portion 20*d*, and the like are formed in the toner containing portion 20. The gear portion 20*a* engages with the drive portion on the main assembly 200 side to transmit the rotational driving force from the main assembly 200 side to the toner storing portion 20. The pump portion 20*b* is a resin displacement type pump whose volume is variable with the reciprocating motion. An arrow ω and an arrow γ in part (a) of FIG. 2 and part (b) of FIG. 2 indicate the moving direction of the pump portion 20*b*.

Specifically, as shown in part (a) of FIG. 2 and part (b) of FIG. 2, the pump portion 20*b* alternately periodically alternates "crest fold" portions and "bottom fold" portions in the longitudinal direction. The pump portion 20*b* expands and contracts by reciprocating motion and functions as a sucking and discharging mechanism for alternately carrying out the sucking operation and the discharge operation through the discharge opening 21*a*. A cam-shaped groove portion 21*b* is formed on the inner peripheral surface of the flange portion 21 and engages with the projection portion 20*d* provided in the toner storing portion 20.

Figure 3:
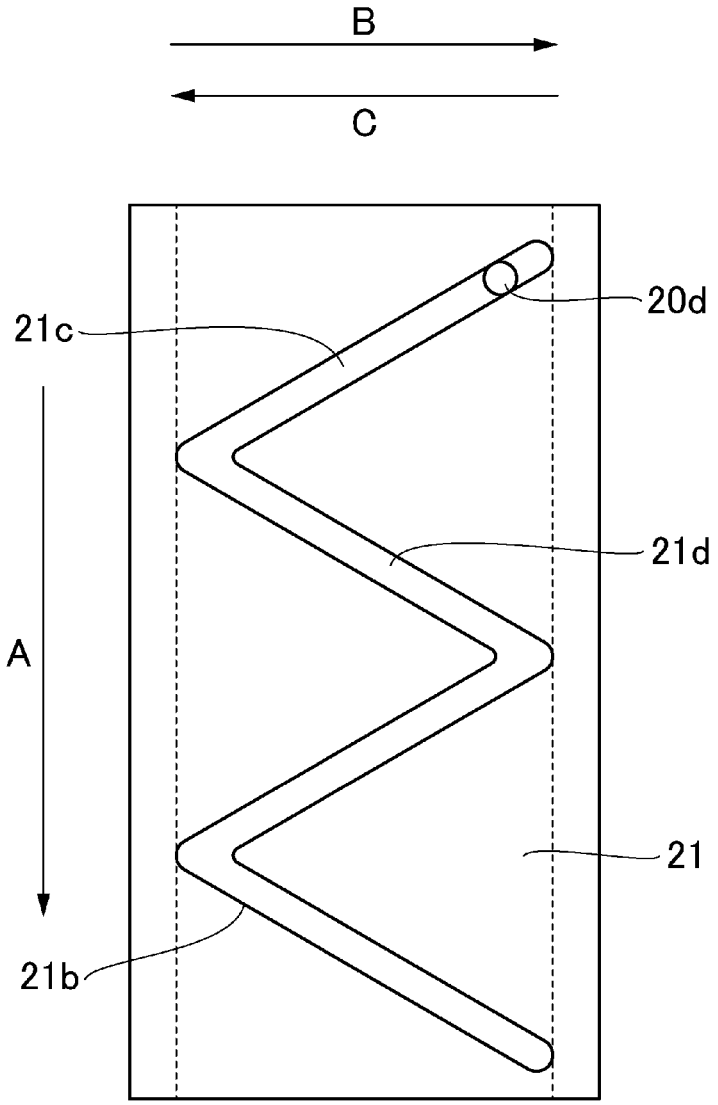
FIG. 3 is an illustration of a mechanism that operates the pump portion according to Embodiment 1.

Referring to FIG. 3, the relationship between the projection 20*d* and the groove 21*b* will be described. FIG. 3 is a schematic view illustrating a portion in which the groove 21*b* is formed in an expanded state. In FIG. 3, the arrow An indicates the rotational direction of the toner container 20 (the moving direction of the projection 20*d*), and the arrows B and C indicate the expansion/contracting direction of the pump portion 20*b*. In the groove 21*b*, as shown in FIG. 3, first grooves 21*c* and second grooves 21*d* including different inclining directions are alternately connected. The toner container 20 is rotationally driven to relatively move in the rotational axis direction with respect to the flange 21 by the engagement between the projection 20*d* and the groove 21*b*. By this, the pump portion 20*b* effects expansion/contracting operation. In other words, when the toner container 20 is rotated, the pump portion 20*b* carries out an expansion and contracting operation, whereby toner is discharged from the discharge opening 21*a* by using the suction and discharging mechanism.

[Driving Structure of Toner Supplying Portion]

A structure of a toner supplying portion 400 on the apparatus main assembly 200A side where a supplying toner (toner for supply) is supplied from an accommodating container Ta to the developing device 100*a* will be described with reference to FIGS. 4 to 6. Constitutions of toner supplying portions for supplying toners from other accommodating containers Tb-Td to the developing devices 100*b*-100*d* are the same as the constitution of the toner supplying portion 400 for supplying the toner from the accommodating container Ta to the developing device 100*a*, and therefore will be omitted from description.

Figure 4:
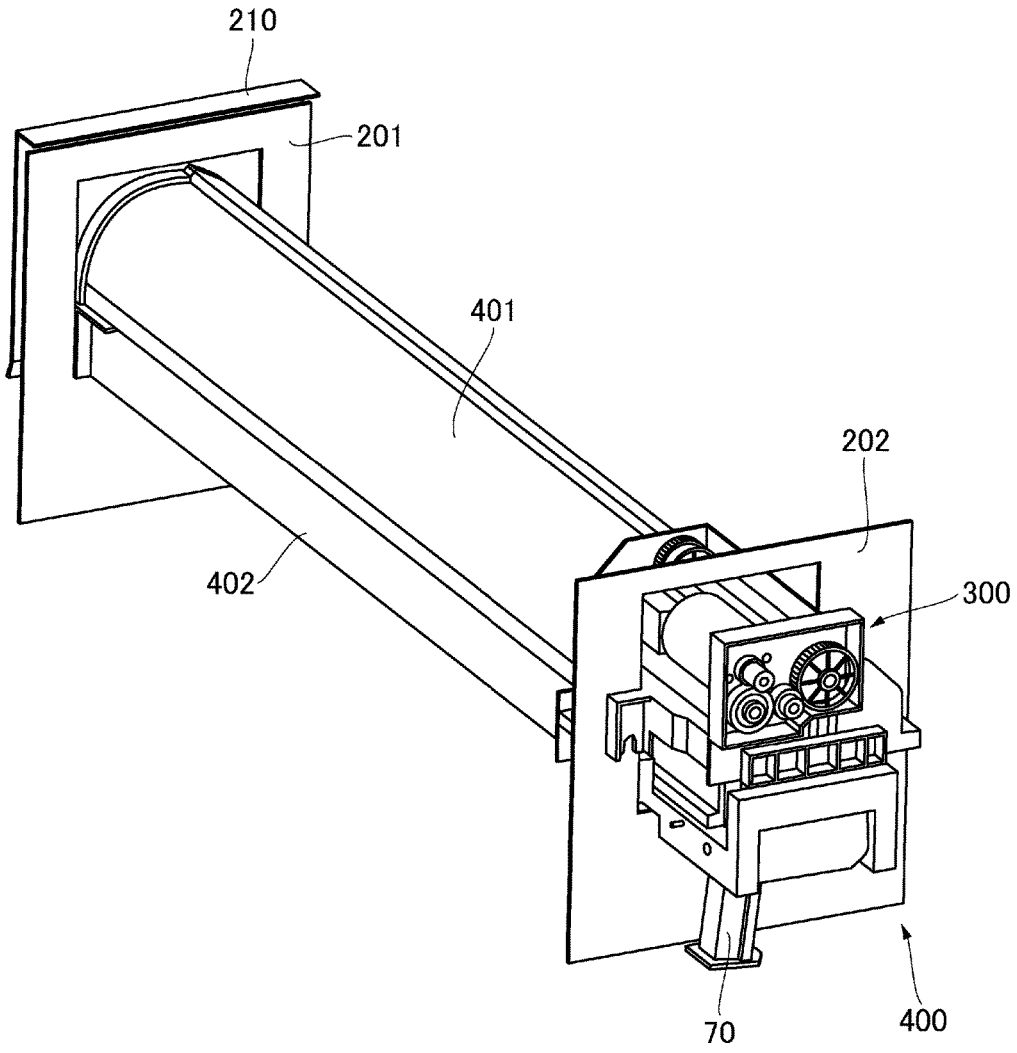
FIG. 4 is a perspective view illustrating a structure of the toner replenishing portion according to Embodiment 1.

As shown in FIG. 4, the apparatus main assembly 200A includes a front-side plate 201, a rear-side plate 202, and an upper container holding guide 401 and a lower container holding guide 402 which are held by the front-side plate 201 and the rear-side plate 202. The accommodating container Ta is detachably mountable to the apparatus main assembly 200A, and when the accommodating container Ta is mounted in the apparatus main assembly 200A, the accommodating container Ta is rotatably accommodated and held by the upper container holding guide 401 and the lower container holding guide 402.

In this embodiment, the accommodating container Ta is mounted in the apparatus main assembly 200A by being inserted from a front side toward a rear side in a substantially horizontal direction (inserting direction), and is pulled out from the apparatus main assembly 200A by being pulled out in an opposite direction (pulling-out direction) to the inserting direction. The inserting direction and the pulling-out direction of such an accommodating container Ta are the same as a longitudinal direction of the accommodating container Ta and an expansion and contraction direction of a pump portion 20*b*, and further the same as a rotational axis direction of the accommodating container Ta. Incidentally, the front side of the apparatus main assembly 200A is a side where a user operates the image forming apparatus 200 and is a front side on the drawing sheet of FIG. 1, and the rear side is a rear side on the drawing sheet of FIG. 1.

On the rear-side plate 202, a container driving device 300 and a supply pipe 70 are mounted. The container driving device 300 is, as shown in FIG. 5, constituted by a driving motor 301 as a driving source, a container driving gear 302 as a drive transmitting portion, a pinion gear 304, an idler gear 305, a stepped idler gear 308, a drive transmitting gear 306, and a container driving shaft 307. In the container driving device 300, a rotational driving force generating from the driving motor 301 is transmitted to the container driving gear 302 through the pinion gear 304, the idler gear 305, the stepped idler gear 308, the drive transmitting gear 306, and the container driving shaft 307. Then, the rotational driving force is transmitted from the container driving gear 302 to a gear portion 20*a* as a discharging driving portion of the accommodating container Ta, so that the accommodating container Ta is rotationally driven, and as described above, the toner is discharged from the accommodating container Ta.

The container driving device 300 is provided with a rotatably supported phase detecting flag 309 and contacts the toner accommodating portion 20 of the accommodating container Ta and a cam portion 24 rotating integrally with the gear portion 20*a*. The cam portion 24 is, as shown in parts (a) and (b) of FIG. 6, provided with a large-diameter portion 24*a* and a small-diameter portion 24*b* alternately at each of two places through one-full circumference of the cam portion 24.

Figure 6:
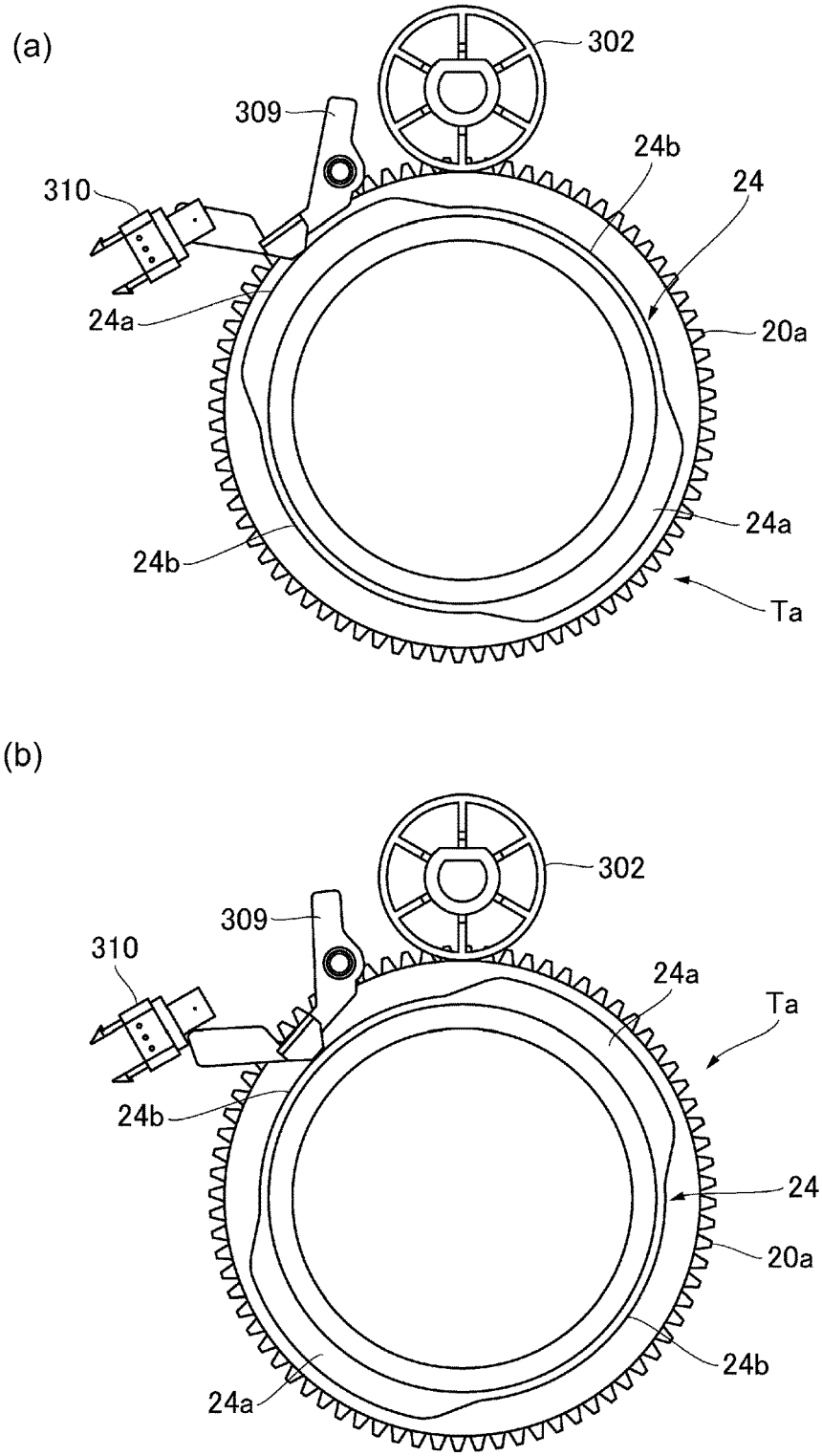
FIG. 6 is a side view of a rotation detection mechanism for detecting rotation of the container, wherein part (a) shows a state where the flag shields the sensor, part (b) shows the state where the flag does not shield the sensor in Embodiment 1.

As shown in part (a) of FIG. 6, when the phase detecting flag 309 contacts the large-diameter portion 24*a*, the phase detecting flag 309 blocks light from reaching a photo-sensor 310 provided in the container driving device 300. On the other hand, as shown in part (b) of FIG. 6, when the phase detecting flag 309 contacts the small-diameter portion 24*b*, the phase detecting flag 309 is deviated from a light transmission range of the photo-sensor 310, so that the light passes through the photo-sensor 310. The controller 50 (FIG. 1) is capable of detecting half rotation of the accommodating container Ta by detecting a change (light blocking→light transmission→light blocking) of the photo-sensor 310. Further, rotation of the driving motor 301 is controlled by the controller 50 so that after the photo-sensor 310 detects light blocking→light transmission→light blocking, the photo-sensor 310 is stopped after a lapse of a predetermined time. The pump portion 20*a* reciprocates once every half rotation of the accommodating container Ta.

Figure 1:
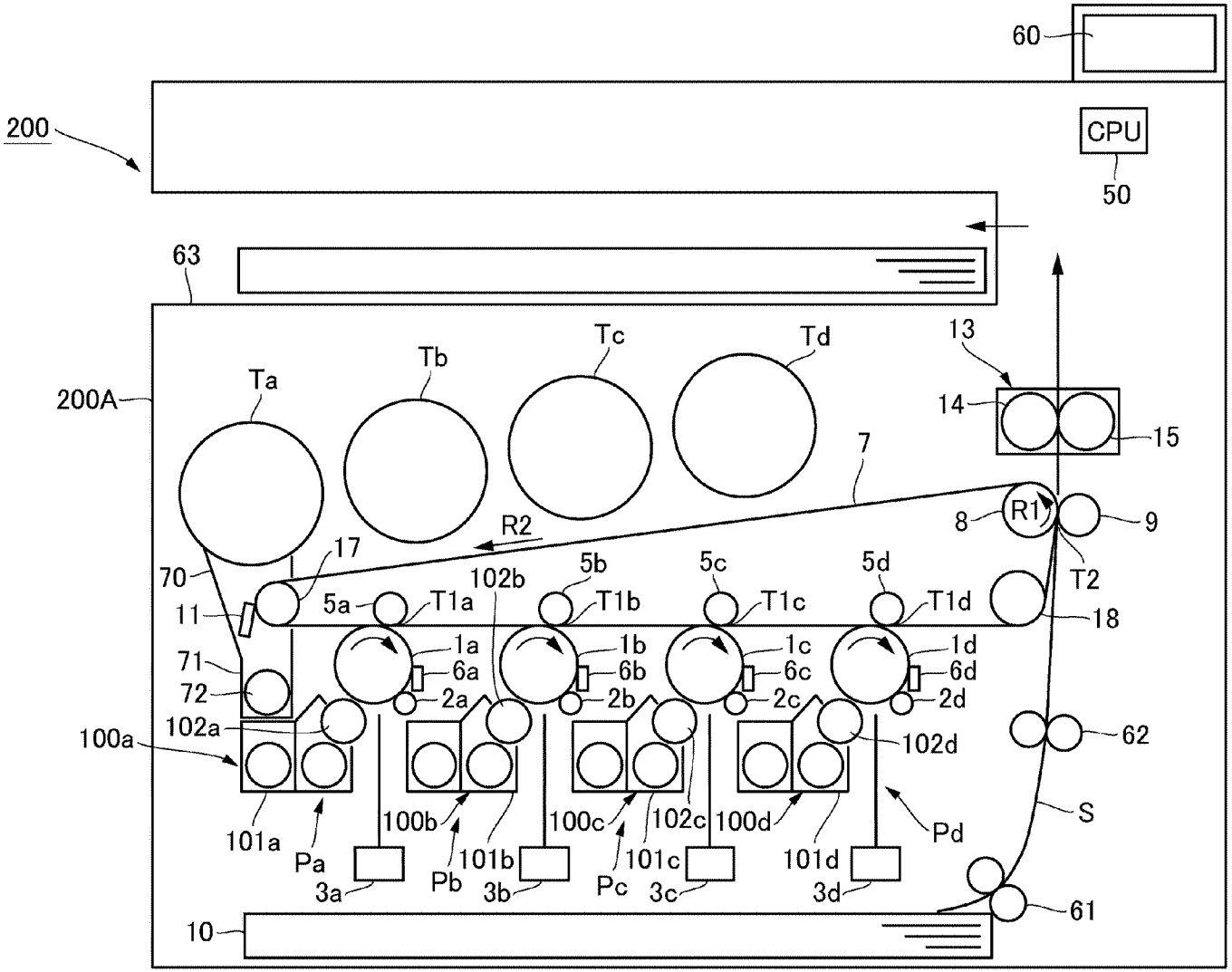
FIG. 1 is a general arrangement of an image forming apparatus according to Embodiment 1.

Thus, the controller 50 controls discharge of the toner from the accommodating container Ta by causing the accommodating container Ta to reciprocate once every half rotation of the accommodating container Ta and then by causing the accommodating container Ta to stop rotation thereof. The toner discharged from the accommodating container Ta passes through a supply pipe 70 and is delivered to the developing device 100*a* (FIG. 1) provided on a downstream side. In this embodiment, as shown in FIG. 1, a hopper 71 for once storing the toner and then for supplying the toner to the developing device 200 appropriately depending on an image forming operation or the like is provided at a downstream end portion of the supply pipe 70. In the hopper 71, a supplying screw 72 is provided, and a controller 50 causes the supplying screw 72 to rotate depending on a toner consumption amount in the developing device 100*a*, so that the toner is supplied to the developing device 100*a*.

[Mounting and Demounting of Accommodating Container]

Next, using parts (a) to (d) of FIG. 7 and FIG. 8, a mounting and demounting mechanism of the accommodating container Ta relative to the apparatus main assembly 200A will be described. Incidentally, the apparatus main assembly 200A includes a receiving device for receiving the accommodating container Ta. As shown in parts (a) to (d) of FIG. 7, with respect to the inserting direction (predetermined direction, arrow D direction) of the accommodating container Ta, at one side end portion (downstream end portion) of the lower container holding guide 402, a container pulling-in device 410 as a pulling-in means is provided. The container pulling-in device 410 includes a container pulling-in lever 403 and a pulling-in spring 404. The container pulling-in lever 403 is rotatably held by the lower container holding guide 402. The pulling-in spring 404 is stretched by the container pulling-in lever 403 and the lower container holding guide 402.

Figure 7:
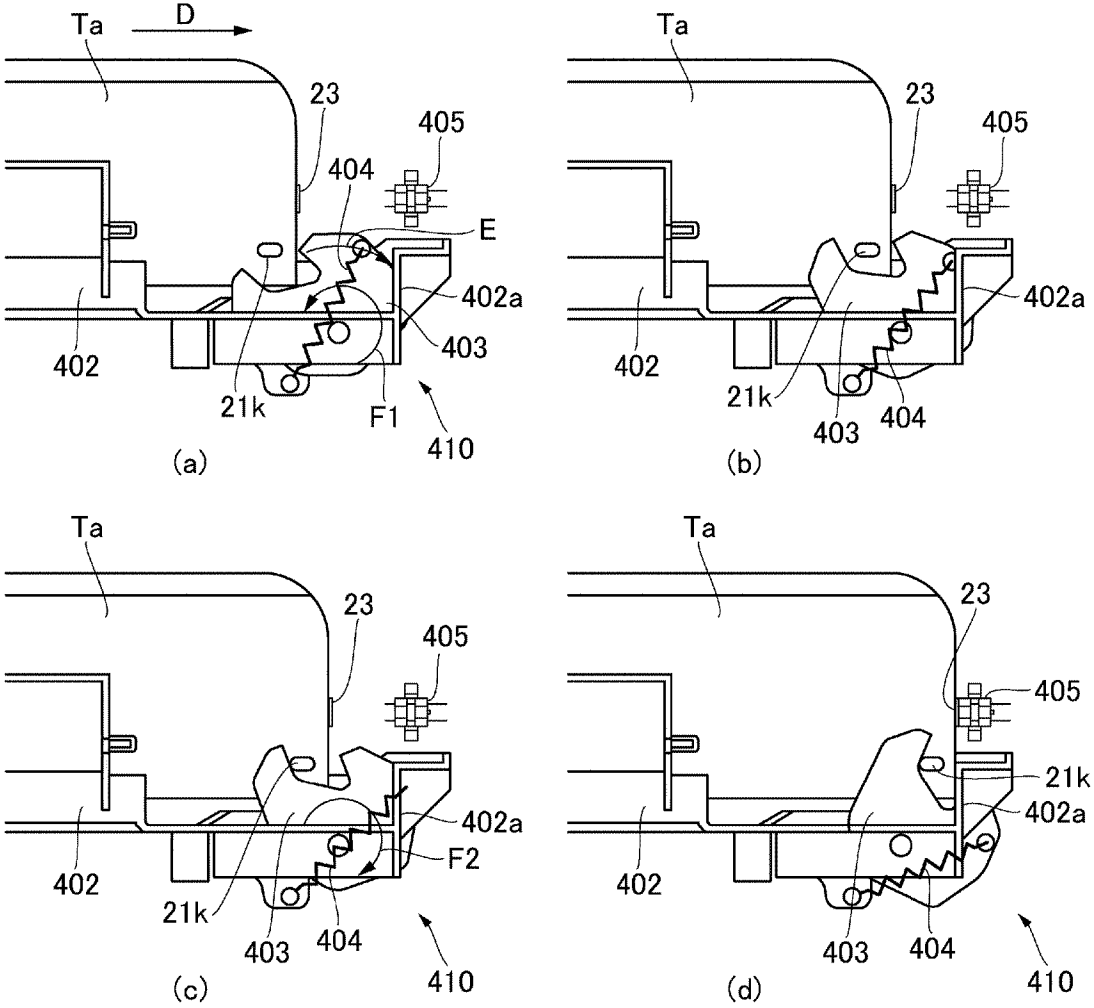
FIG. 7 is a side view of a dismounting mechanism for the accommodating container, and, part (a) shows a first state, part (b) shows a second state, (c) shows a third state, (d) shows a fourth state in Embodiment 1.

When the accommodating container Ta is mounted in the apparatus main assembly 200A, first, as shown in part (a) of FIG. 7, a free end (downstream end with respect to the inserting direction) of the accommodating container Ta and the container pulling-in lever 403 contact each other, so that the container pulling-in lever 403 starts rotation in an arrow E direction in a pulling-in form. At this time, a force by the pulling-in spring 404 acts as a force for rotating the container pulling-in lever 403 in an arrow F1 direction.

Further, when the accommodating container Ta is pushed in the apparatus main assembly 200A, as shown in part (b) of FIG. 7, the container pulling-in lever 403 is further rotated, so that a position of the pulling-in spring 404 exceeds a dead center (where a rotation center of the container pulling-in lever 403 is placed on a rectilinear line connecting spring holding portions). Then, as shown in part (c) of FIG. 7, the direction of the force for rotating the container pulling-in lever 403 by the pulling-in spring 404 is switched to an arrow F2 direction. Then, the container pulling-in lever 403 engages with a boss 21*k*, so that a force for pulling in the accommodating container Ta toward the rear side acts on the accommodating container Ta.

As a result, as shown in part (d) of FIG. 7, the accommodating container Ta is automatically pulled to an abutting portion 402*a* provided as a part of the lower container holding guide 402 by further rotating the container pulling-in lever 403 by an urging force of the pulling-in spring 404. When free end of the accommodating container Ta abuts against the abutting portion 402*a*, a mounting operation of the accommodating container Ta into the apparatus main assembly 200A is completed, and as described later, the accommodating container Ta is mounted at a first position where the toner is capable of being discharged from the accommodating container Ta. That is, the container pulling-in lever 403 engages with the boss 21*k* as a part of the accommodating container Ta during mounting of the accommodating container Ta into the apparatus main assembly 200A and pulls in the accommodating container Ta to the first position by the urging force of the pulling-in spring 404.

Here, at one end of the accommodating container Ta, a container-side contact (point) 23 as a first contact (point) is provided. At a position where the apparatus main assembly 200A opposes the one end of the accommodating container Ta, main assembly-side contact (point) 405 as a second contact (point) is provided. The main assembly-side contact 405 contacts the container-side contact 23 and thus enables communication between the accommodating container Ta and the apparatus main assembly 200A. The container-side contact 23 is connected with a memory in which information on the accommodating container Ta is stored. When the accommodating container Ta is mounted in the first position, the container-side contact 23 contacts the main assembly-side contact 405, so that this information is sent to the controller 50 of the apparatus main assembly 200A.

Figure 8:
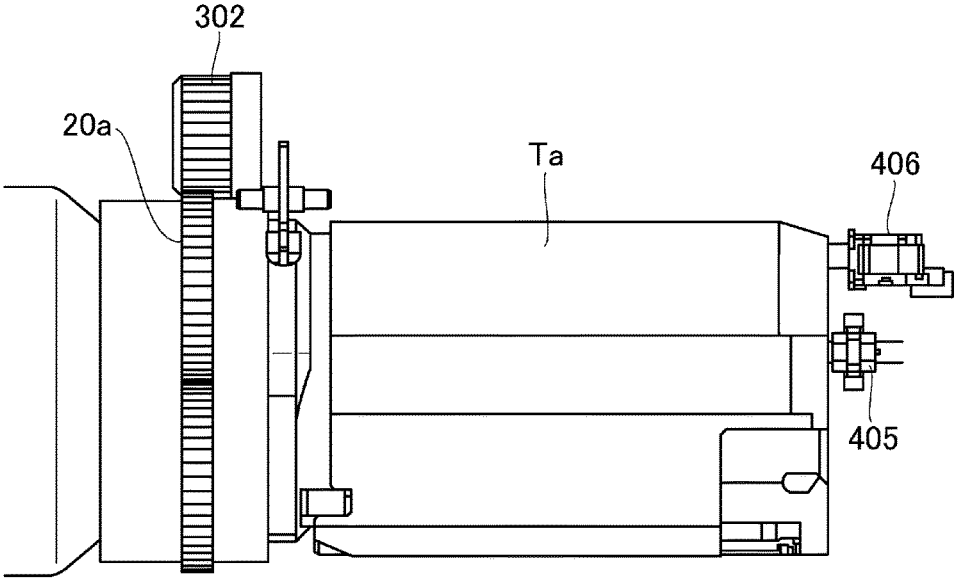
FIG. 8 is a side view illustrating a detecting portion for the accommodating container according to the Embodiment 1.

Further, as shown in FIG. 8, at a position where the apparatus main assembly 200A opposes the one end of the accommodating container Ta, a sensor 406 as a detecting means for detecting the accommodating container Ta by contact thereof with the accommodating container Ta is provided. The sensor 406 detects whether or not the accommodating container Ta is mounted in the first position. Accordingly, when the accommodating container Ta is mounted in the first position the accommodating container Ta is mounted in the first position, the sensor 406 contacts the one end of the accommodating container Ta, and the controller 50 discriminates that the accommodating container Ta was mounted in the first position. On the other hand, when the sensor 406 does not contact the one end of the accommodating container Ta, the controller 50 discriminates that the accommodating container Ta was not mounted in the first position.

Figure 5:
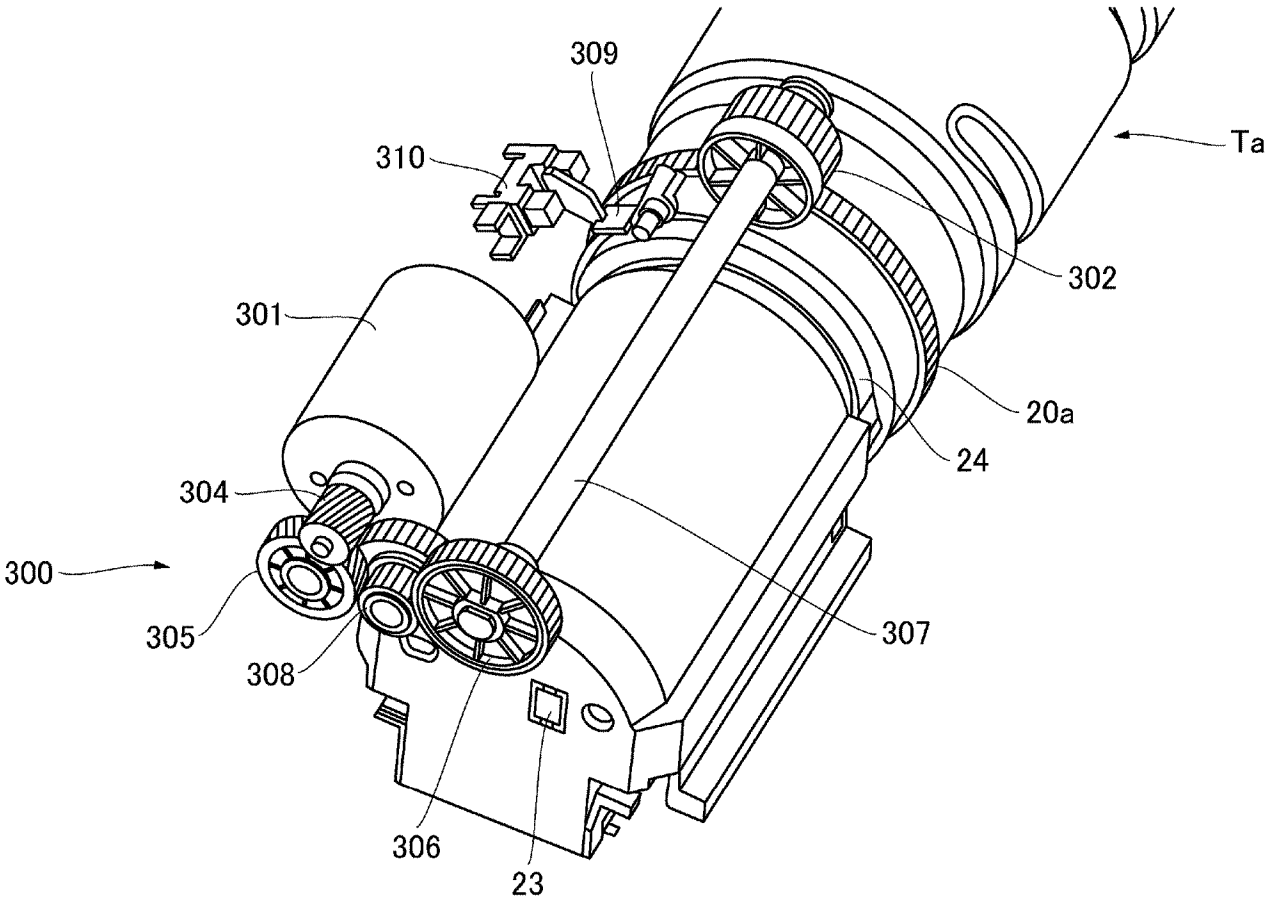
FIG. 5 is a perspective view illustrating a driving structure for the accommodating container according to Embodiment 1.

Further, in a state that the accommodating container Ta was mounted in the first position of the apparatus main assembly 200A, as shown in FIG. 5, the container driving gear 302 provided in the apparatus main assembly 200A engages with the gear portion 20*a* provided on the accommodating container Ta side. Thus, drive (driving force) can be transmitted from the container driving gear 302 to the gear portion 20*a*.

[Opening and Closing of Shutter]

Next, using parts (a) and (b) of FIG. 9 and parts (a)-(c) of FIG. 10, mounting and demounting of the accommodating container Ta relative to the apparatus main assembly 200A and opening and closing of the shutter 4 provided as a part of the accommodating container Ta will be described. As described above in parts (a) and (b) of FIG. 2, the shutter 4 is provided inside the accommodating container Ta so as to be movable relative to the flange portion 21. As described above, the accommodating container Ta is provided with the discharge opening 21*a* and includes the shutter 4 capable of opening and closing the discharge opening 21*a*.

Figure 9:
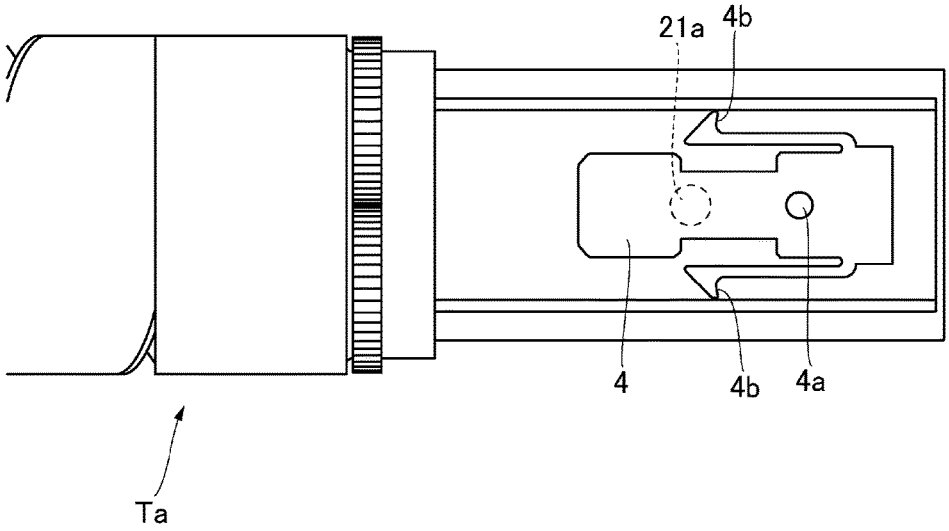
FIG. 9 is a bottom view of the accommodating container, in which part (a) shows the shutter closed state, and part (b) shows the open state of the shutter in Embodiment 1.
Figure 9:
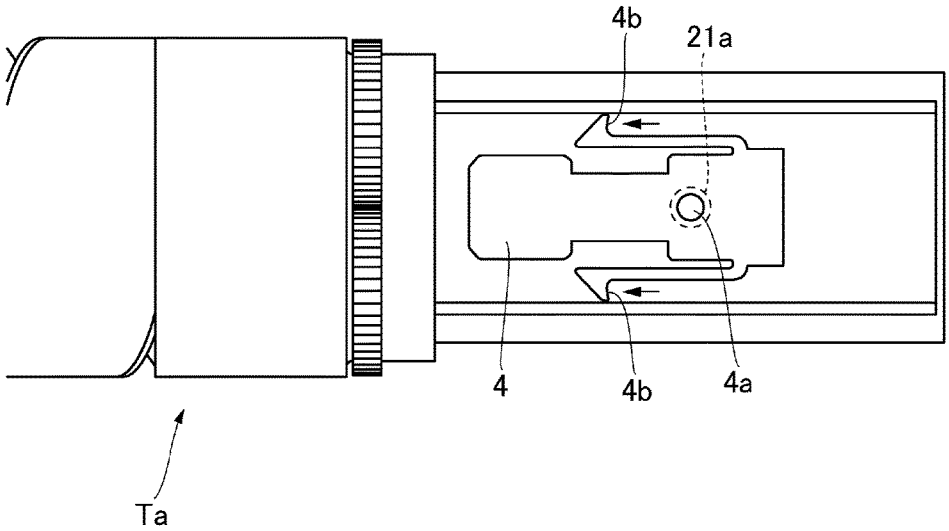

The shutter 4 is provided with an opening 4*a* as shown in parts (a) and (b) of FIG. 9. A positional relationship between the opening 4*a* of the shutter 4 and the discharge opening 21*a* is, in the case of part (a) of FIG. 9, such that the shutter 4 closes the discharge opening 21*a*, and therefore, the toner cannot be discharged from the accommodating container Ta. On the other hand, in the case that the shutter 4 is slid (moved) to a position of part (b) of FIG. 9, the opening 4*a* of the shutter 4 and the discharge opening 21*a* overlap with each other, so that the opening 4*a* and the discharge opening 21*a* communicate with each other. For that reason, the toner can be discharged from the accommodating container Ta through the discharge opening 21*a* and the opening 4*a*.

Figure 10:
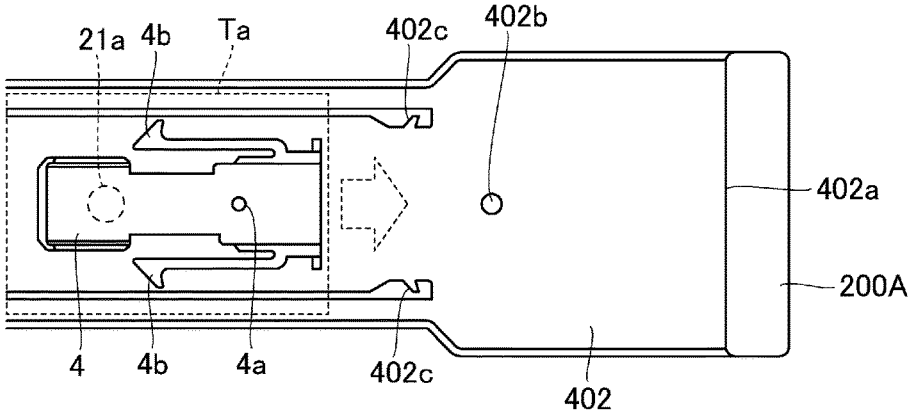
In FIG. 10, part (a) shows a state of the receiving container is being mounted, part (b) shows a state in which the discharge opening of the accommodating container and the discharge opening of the shutter do not communicate with each other, and part (c) shows a state where the discharge opening of the accommodating container and the discharge opening of the shutter communicate with each other in Embodiment 1.
Figure 10:
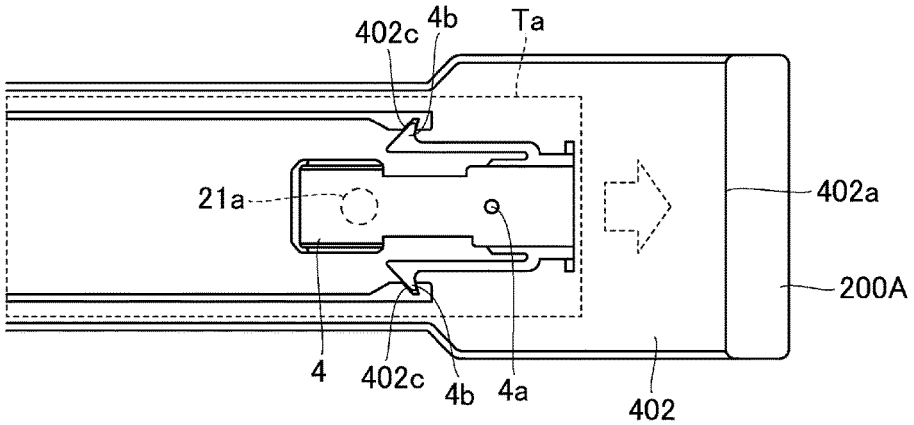
Figure 10:
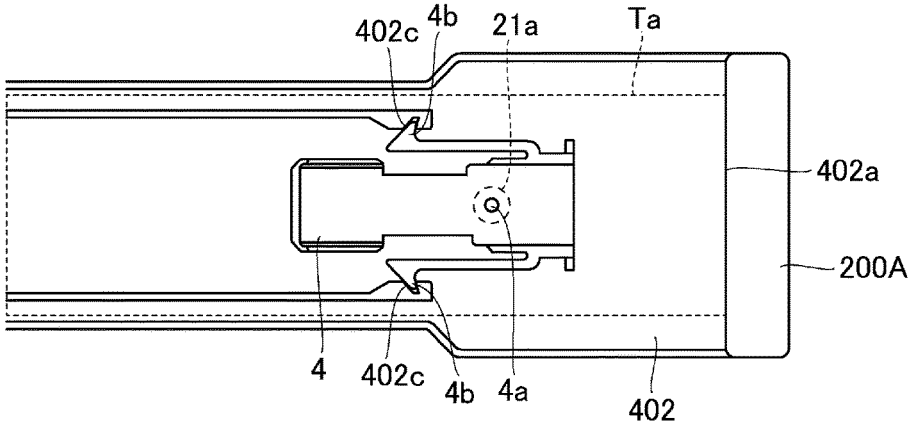

Parts (a)-(c) of FIG. 10 are schematic views each showing a positional relationship between the accommodating container Ta and the shutter 4 on the lower container holding guide 402. Further, parts (a)-(c) of FIG. 10 sequentially show a process of mounting the accommodating container Ta into the apparatus main assembly 200A, and broken arrows represent the movement direction (inserting direction) of the accommodating container Ta.

A positional relationship between the accommodating container Ta and the shutter 4 in a state that the accommodating container Ta is not mounted in the apparatus main assembly 200A is, as shown in part (a) of FIG. 9, is a state that the shutter 4 closes the discharge opening 21*a*. Accordingly, insertion of the accommodating container Ta into the apparatus main assembly 200A is started in this state, and also in the state of part (a) of FIG. 10, the discharge opening 21*a* is kept closed by the shutter 4.

Then, when the accommodating container Ta is further inserted into the apparatus main assembly 200A, as shown in part (b) of FIG. 10, a shutter engaging groove 402*c* formed on the lower container holding guide 402 and a projection 4*b* formed on the shutter 4 engage with each other. At this time, positions of a discharge opening 402*b* formed in the lower container holding guide 402 and the opening 4*a* formed in the shutter 4 overlap and communicate with each other, but do not communicate with the discharge opening 21*a*. for this reason, in this state, the toner is not yet discharged from the accommodating container Ta.

From this state, when the accommodating container Ta is further inserted into the apparatus main assembly 200A, by engagement between the shutter engaging groove 402*c* and the projection 4*b*, the shutter 4 is fixed to the lower container holding guide 402, and therefore, the accommodating container Ta excluding the shutter 4 is moved relative to the lower container holding guide 402. That is, the accommodating container Ta and the shutter 4 perform relative movement therebetween. Further, as shown in part (c) of FIG. 10, when the accommodating container Ta is further inserted into the apparatus main assembly 200A until it runs against the abutting portion 402*a* of the apparatus main assembly 200A, movement of the accommodating container Ta relative to the shutter 4 is performed to a position where the discharge opening 402*b* communicates with the discharge opening 21*a* and the opening 4*a*. That is, all of the discharge opening 21*a*, the opening 4*a* and the discharge opening 402*b* communicate with each other, so that the toner can be discharged from the accommodating container Ta. Thus, the image forming apparatus 200 of this embodiment has a constitution in which only in the case that the accommodating container Ta is mounted into the apparatus main assembly 200A in the first position, the toner can be discharged from the accommodating container Ta.

[Package Transportation]

Here, package transportation such that the accommodating container Ta is transported in a state in which the accommodating container Ta is mounted into the apparatus main assembly 200A is performed in a state in which the accommodating container Ta is mounted into the apparatus main assembly 200A in the first position as described above, there is a liability that the following problem arises. That is, in the state in which the accommodating container Ta is mounted in the first position, as described above, the container-side contact 23 contacts the main assembly-side contact 405, so that the sensor 406 contacts the one end of the accommodating container Ta. Further, the container driving gear 302 is connected with the gear portion 20*a* provided on the accommodating container Ta side. Thus, when the image forming apparatus is transported in a state that various devices are connected with and in contact with each other between the accommodating container Ta and the apparatus main assembly 200A, there is a liability that the accommodating container Ta vibrates during transportation, and loads are exerted on the various devices. That is, there is a liability that the loads are exerted on a contact portion between the container-side contact 23 and the main assembly-side contact 405, the sensor 406, and a connecting portion between the container driving gear 302 and the gear portion 20*a*.

Therefore, in this embodiment, in the apparatus main assembly 200A, the accommodating container Ta is mountable in each of the above-described first position and a second position which is different from the first position and in which the toner is not discharged from the accommodating container Ta. Further, in the case of the package transportation, a position of the accommodating container Ta is regulated (limited) to the second position by a regulating (limiting) member 500 as a regulating (limiting) means. This second position is a position upstream of the first position with respect to the inserting direction (predetermined direction) of the accommodating container Ta. Further, the second position is a position where the sensor 406 does not contact the one end of the accommodating container Ta and the container-side contact 23 does not contact the main assembly-side contact 405 and where the container driving gear 302 is not connected with the gear portion 20*a*.

[Regulating Member]

Figure 11:
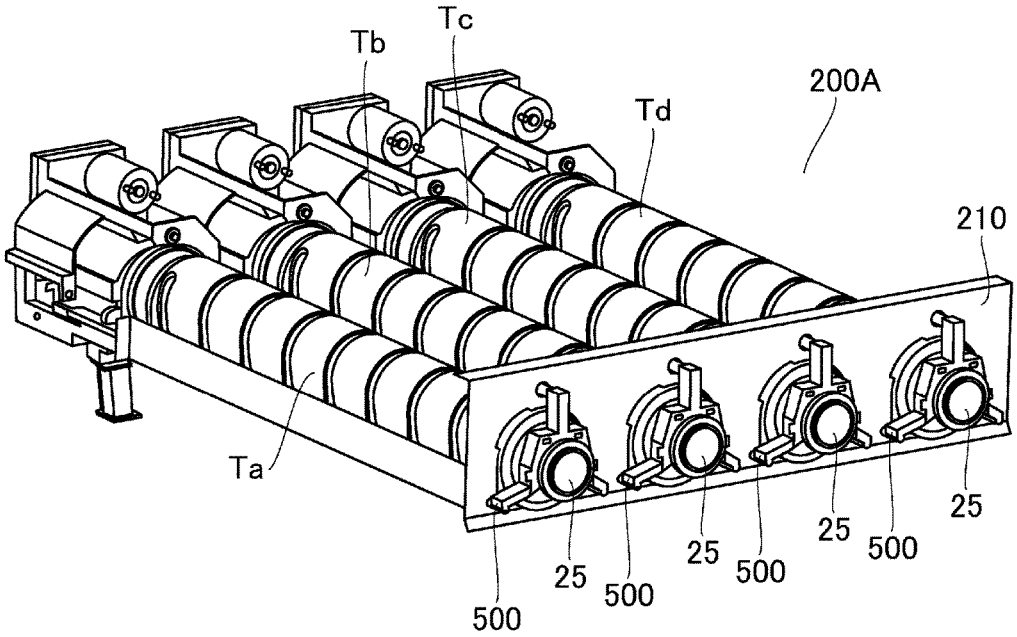
FIG. 11 is a perspective view illustrating a state in which the accommodating container according to the Embodiment 1 is placed in the apparatus main assembly into a single package.

The regulating member 500 for regulating the accommodating container Ta to the second position of the apparatus main assembly 200A as described above will be described using FIGS. 11-16. FIG. 11 is a perspective view showing a mounting state of the accommodating container Ta when the accommodating container Ta is mounted in the second position of the apparatus main assembly 200A and is transported. Specifically, this will be described later, but the regulating member 500 is mounted to a grip portion 25 provided at each of upstream end portions of the accommodating containers Ta-Td for the respective colors with respect to the accommodating containers Ta-Td. Then, the regulating members 500 regulate positions of the accommodating containers Ta-Td to the second position in a state that each of the regulating members 500 is sandwiched between the grip portion 25 and an inserting opening cover 210, and in this state, the transportation of the image forming apparatus is carried out. That is, the regulating member 500 is disposed detachably mountable between the accommodating container Ta and the inserting opening cover 210 (part of the apparatus main assembly) and regulates the accommodating container Ta to the first position in a non-mounted state and regulates the accommodating container Ta to the second position in the mounted state. Constitutions for regulating the positions of the accommodating containers Ta-Td to the second position are the same, and therefore, in the following, the constitution for regulating the position of the accommodating container Ta to the second position will be described specifically as a representative.

Figure 12:
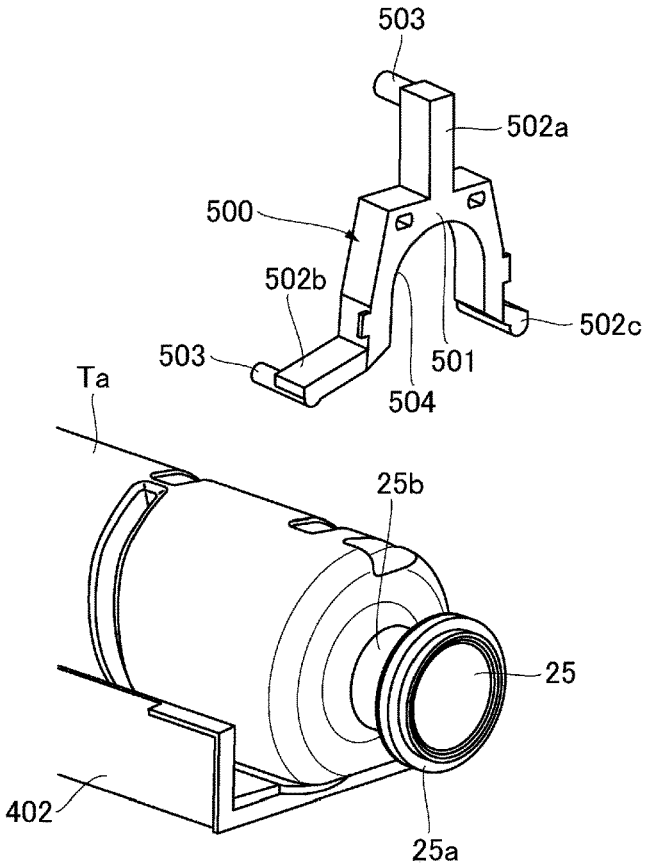
In FIG. 12, part (a) is a perspective view illustrating a state in which the regulating member is separated from the accommodating container, and part (b) is a perspective view illustrating a state in which a regulating member is mounted on an accommodating container in Embodiment 1.
Figure 12:
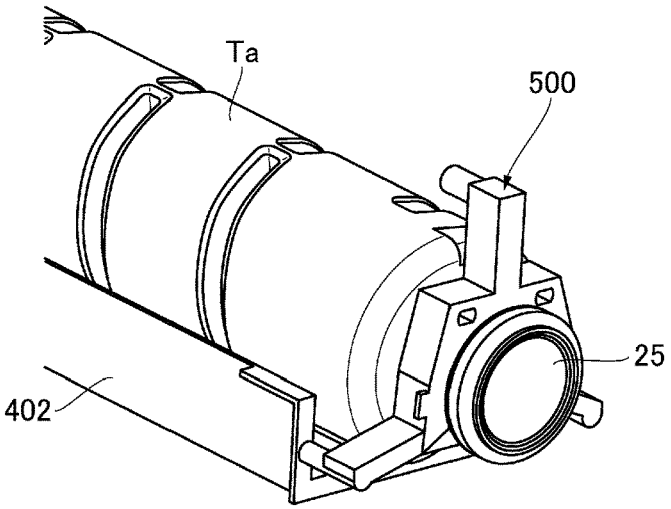

As shown in parts (a) and (b) of FIG. 12, the accommodating container Ta includes the grip portion 25 as a portion-to-be mounted where the regulating member 500 is mountable at the upstream end portion with respect to the inserting direction (predetermined direction) of the accommodating container Ta. As shown in part (a) of FIG. 12, the grip portion 25 is partly necked so that the user or the like can easily grip the grip portion 25 with a hand. That is, the grip portion 25 is provided so as to project from an upstream end (rear end) of the accommodating container Ta toward a further upstream side with respect to the inserting direction of the accommodating container Ta and is formed so that an outer diameter thereof is larger at an upstream portion than a base end portion or an intermediary portion on the accommodating container Ta side. Further, the upstream portion is a large-diameter portion 25*a*, and the base end portion or the intermediary portion is a necked portion 25*b*.

On the other hand, the regulating member 500 includes a base portion 501, projected portions 502*a*, 502*b* and 502*c*, and abutting projections 503. The projected portions 502*a*, 502*b* and 502*c* are provided so as to be projected from three positions of the base portion 501 in a radial direction of the accommodating container Ta in a mounted state to the accommodating container Ta. The abutting projections 503 are provided so as to project from the projected portions 502*a*-502*c*, respectively, in the inserting direction. The base portion 501 is provided with a recessed portion 504 recessed from between the projected portions 502*b* and 502*c* toward the projected portion 502*a* in a substantially U-shape. The regulating member 500 is, as shown in part (b) of FIG. 12, mounted to the accommodating container Ta by causing the necked portion 25*b* to enter the recessed portion 504.

Figure 13:
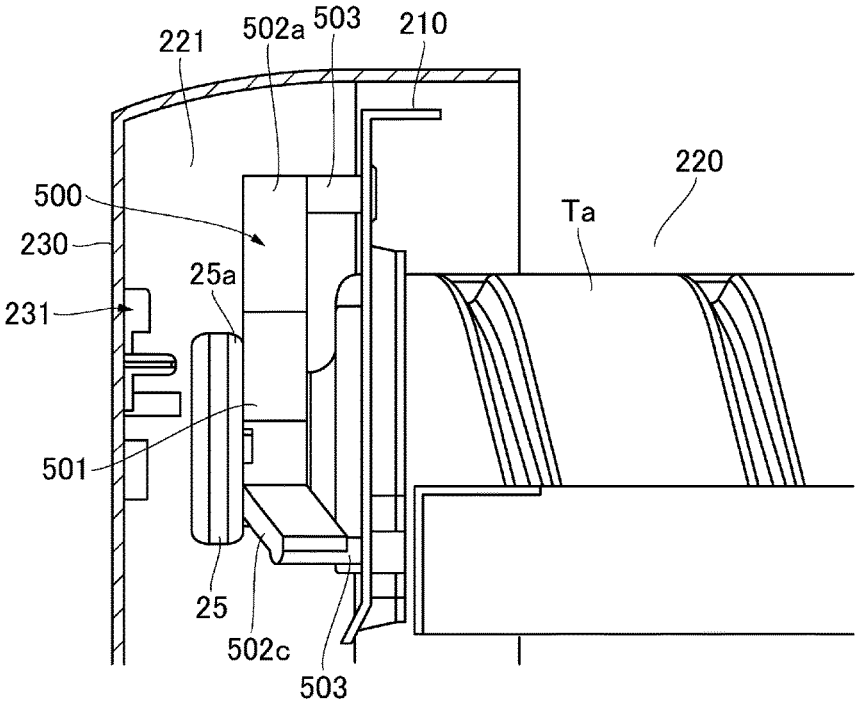
FIG. 13 is a side view in a state where the accommodating container is placed in the apparatus main assembly into a single package, and part (a) shows the upstream end with respect to an inserting direction, part (b) shows the downstream end with respect to the inserting direction in Embodiment 1.
Figure 13:
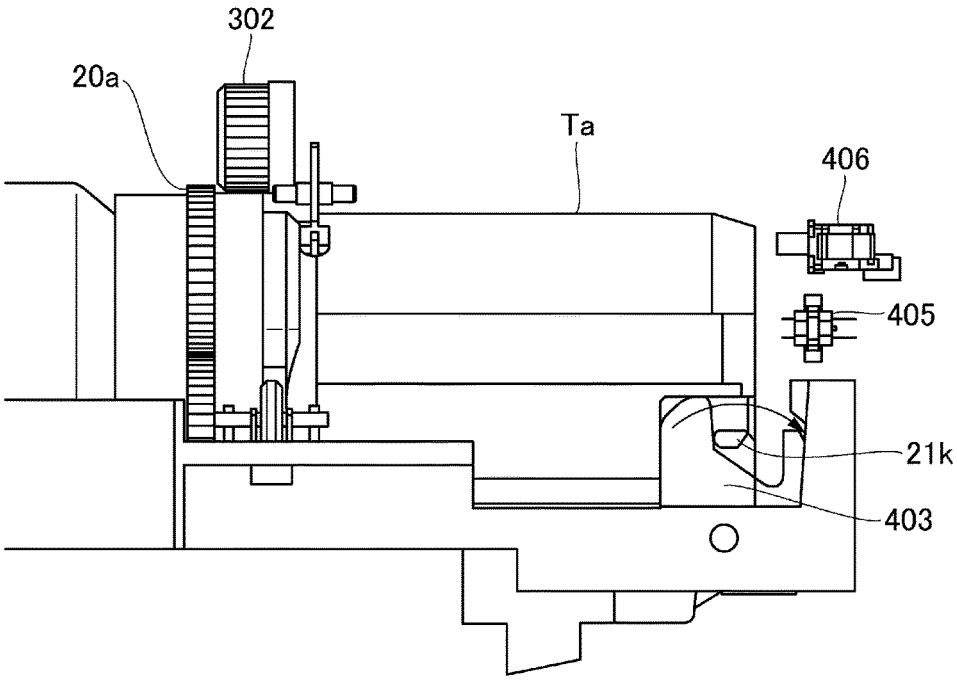
Figure 16:
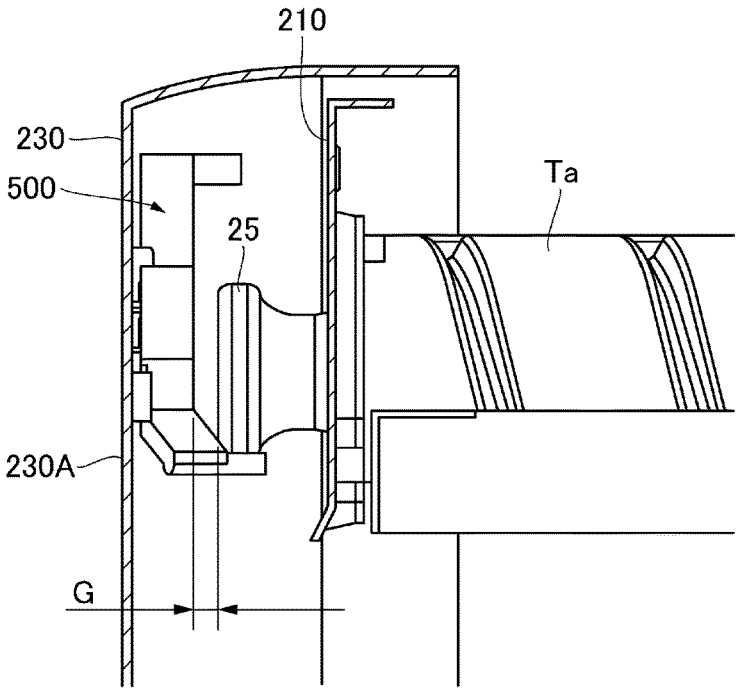
FIG. 16 is a side view of the upstream end portion with respect to the inserting direction in a state where the regulating member according to the Embodiment 1 is accommodated in the storing portion.

As shown in part (a) of FIG. 13, on an entrance side where the accommodating container Ta is mounted in the apparatus main assembly 200A, the inserting opening cover 210 as a contact portion is provided. The inserting opening cover 210 is provided on the front-side plate 201 (FIG. 4), and each of the inserting opening cover 210 and the front-side plate 201 is provided with an inserting opening through which the accommodating container Ta is insertable. The inserting opening cover 210 is provided at a portion where the upstream end portion with respect to the inserting direction (predetermined direction) of the accommodating container Ta is positioned in a state that the accommodating container Ta is mounted in the first position (FIG. 16).

In the case of the package transportation, the accommodating container Ta is mounted in the apparatus main assembly 200A in a state that the regulating member 500 is mounted to the grip portion. At that time, the accommodating container Ta is inserted into the apparatus main assembly 200A while being inserted into the inserting openings provided in the inserting opening cover 210 and the front-side plate 201. Then, as shown in part (a) of FIG. 13, when the accommodating container Ta reaches the second position, the abutting projection 503 of the regulating member 500 mounted on the grip portion 25 abuts against the inserting opening cover 210. At this time, the base portion 501 abuts against the large-diameter portion 25*a* of the grip portion 25, so that the accommodating container Ta is held so as not to move further toward a downstream side with respect to the inserting direction. That is, the regulating member 500 contacts the inserting opening cover 210 in the state that the regulated member 500 is mounted on the grip portion 25, and regulates the position of the accommodating container Ta to the second position located on a side upstream of the first position with respect to the inserting direction.

Thus, in the state that the regulated member 500 is in the second positon, the container pulling-in lever 403 is positioned between the positions of parts (c) and (d) of FIG. 7, and a force in a direction in which the accommodating container Ta is mounted in the apparatus main assembly 200A acts on the accommodating container Ta. For this reason, the accommodating container Ta in a state of being pulled in by the container pulling-in lever 403 is fixed in a state of being regulated by the inserting opening cover 210 through the regulated member 500. In other words, the regulating member 500 regulates the position of the accommodating container Ta to the second position irrespective of the force for pulling-in the accommodating container Ta by the container pulling-in lever 403.

The apparatus main assembly 200A includes a front door 230 as a cover capable of opening and closing a space 220 into which the accommodating container Ta is inserted. The front door 230 is provided on the front side of the apparatus main assembly 200A and is rotated about a hinge, and thus opens and closes spaces into which the accommodating containers Ta-Td are inserted. The front door 230 is formed so as to be capable of being closed even when the accommodating container Ta in a state that the regulated member 500 is mounted on the grip portion 25 is in the second position.

That is, in this embodiment, as shown in part (a) of FIG. 13, at the second position, the grip portion 25 projects toward the upstream side (front side) than the upstream end portion of the accommodating container Ta with respect to the inserting direction is. For this reason, the front door 230 is configured so that a space 221 such that the front door 230 does not interfere with the grip portion 25 even when the front door 230 is closed in the state that the accommodating container Ta is positioned in the second position.

Further, in the state that the accommodating container Ta is positioned in the second position, as shown in part (a) of FIG. 13, the sensor 406 does not contact the one end of the accommodating container Ta, and the container-side contact 23 and the main assembly-side contact 405 also do not contact each other. Further, at the second position, the container driving gear 302 does not engage with the gear portion 20*a*.

Figure 14:
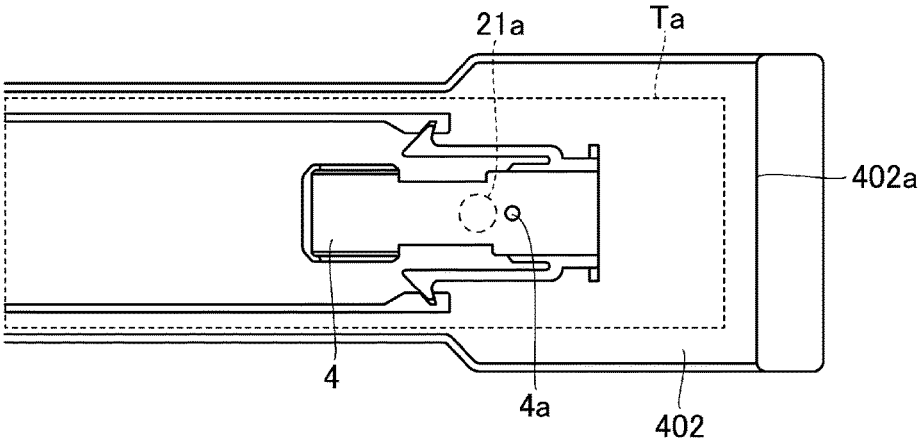
FIG. 14 is an illustration showing the positional relationship between the discharge opening of the accommodating container and the discharge opening of the shutter in the state in which the accommodating container according to the Embodiment 1 is placed in the apparatus main assembly.

Further, in the state that the accommodating container Ta is positioned in the second position, a positional relationship between the discharge opening 21*a* of the flange portion 21 of the accommodating container Ta and the opening 4*a* of the shutter 4 is as shown in FIG. 14. That is, the discharge opening 21*a* and the opening 4*a* do not communicate with each other. For this reason, the toner is not discharged from the accommodating container Ta.

On the other hand, when the regulating member 500 is demounted from the accommodating container Ta, regulation of the position of the accommodating container Ta is eliminated, so that the accommodating container Ta is capable of being inserted to the first position. That is, when the user or the like opens the front door 230 and pulls out the regulating member 500 from the grip portion 25 of the accommodating container Ta, engagement between the abutting projection 503 and the inserting opening cover 210 and engagement between the base portion 501 and the large-diameter portion 25*a* are eliminated, so that the accommodating container Ta is movable from the second position to the first position. At this time, the accommodating container Ta is in a state of being pulled in by the container pulling-in lever 403, and therefore is automatically pulled in to the first position and is mounted in the first position. That is, in this embodiment, the container pulling-in device 410 is constituted so that when the regulation by the regulating member 500 is eliminated at the second position, the container pulling-in device 410 pulls in the accommodating container Ta to the first position.

When the accommodating container Ta is pulled in to the first position, as described above in FIG. 8, the sensor 406 contacts the one end of the accommodating container Ta, so that the accommodating container Ta is detected by the sensor 406. Further, the container-side contact 23 contacts the main assembly-side contact 405, so that communication can be established between the accommodating container Ta and the apparatus main assembly 200A. Further, the container driving gear 302 engages with the gear portion 20*a*, so that the drive can be transmitted from the container driving gear 302 to the gear portion 20*a*. Further, when the accommodating container Ta is mounted in the first position, as shown in part (b) of FIG. 9, the discharge opening 21*a* of the flange portion 21 of the accommodating container Ta and the opening 4*a* communicate with each other, so that the toner can be discharged from the accommodating container Ta.

[Accommodation of Regulating Member]

Figure 15:
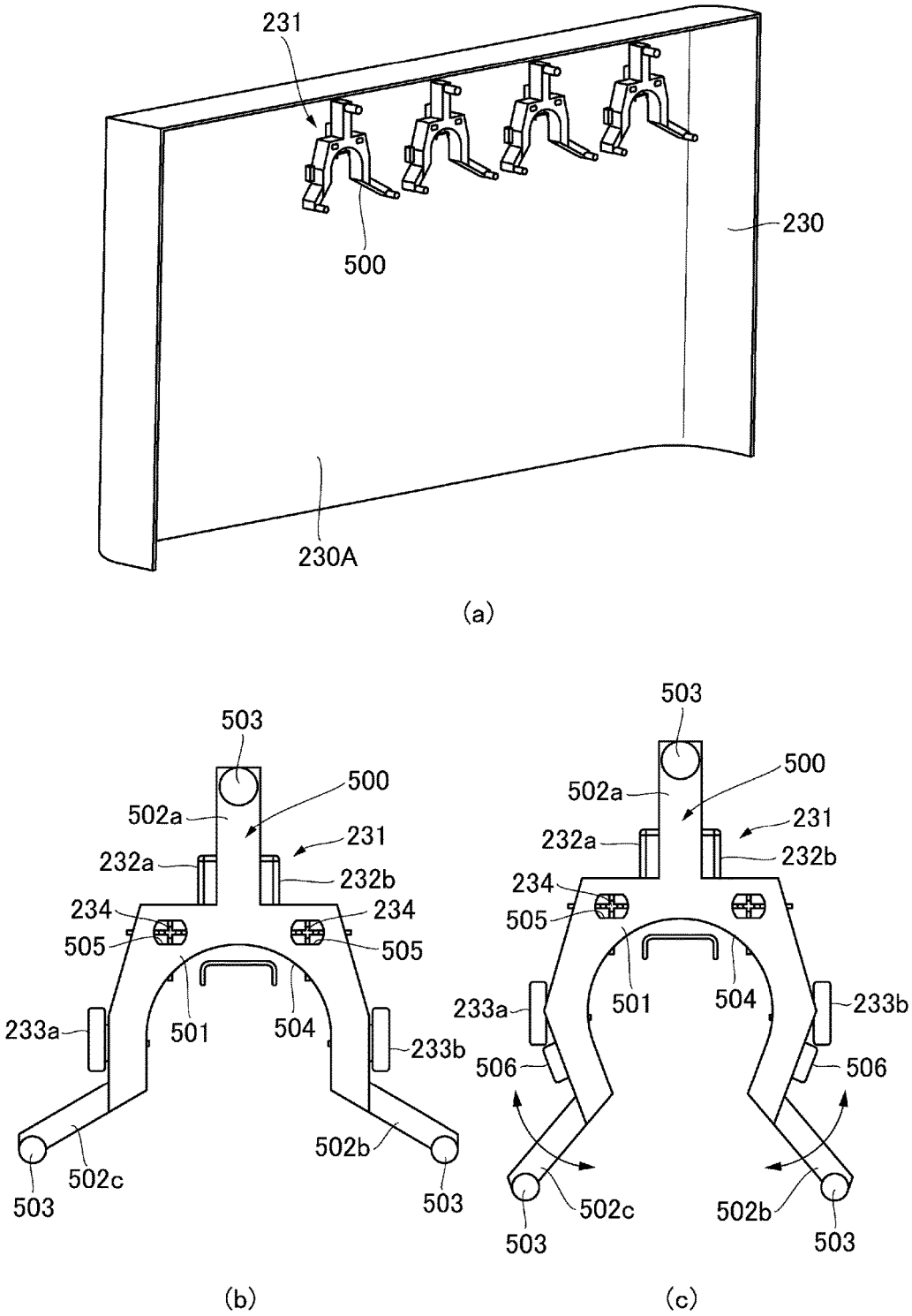
In FIG. 15, part (a) is a perspective view in a state where the regulating member is accommodated in the front door, part (b) is a front view of an accommodating portion in which the regulating member is accommodating, part (c) shows a state when the regulating member is mounted to and dismounted from the container in Embodiment 1.

In the case of this embodiment, as shown in parts (a)-(c) of FIG. 15, an accommodating portion 231 in which the regulating member 500 demounted from the grip portion 25 as described above is provided on the front door 230. The accommodating portion 231 is, as shown in FIG. 16, formed so that the accommodated regulating member 500 does not interfere with the accommodating container Ta even when the front door 230 is closed in the state that the accommodating container Ta is mounted in the first position.

Specifically, the accommodating portion 231 is, as shown in part (a) of FIG. 15, provided at a plate-like portion 230A on a front surface of the front door 230. Such an accommodating portion 231 includes, as shown in part (b) of FIG. 15, a pair of upper engaging portions 232*a* and 232*b*, a pair of lower engaging portions 233*a* and 233*b*, and a pair of projections 234. The pair of upper engaging portions 232*a* and 232*b* sandwiches the projected portion 502*a* of the regulating member 500. The pair of lower engaging portions 233*a* and 233*b* sandwiches the base portion 501. The pair of lower engaging portions 233*a* and 233*b* is provided with engaging grooves with which a pair of engaging plate portions 506 (part (c) of FIG. 15) provided on both sides of the base portion 501 of the regulating member 500 is engageable, respectively. The pair of projections 234 is capable of entering a pair of engaging holes 505, respectively, formed in the base portion 501 of the regulating member 500. Further, regulating member 500 is capable of being deformed in directions indicated by arrows in part (c) of FIG. 15.

When the regulating member 500 is accommodated in the accommodating portion 231, as shown in part (c) of FIG. 15, the base portion 501 is elastically deformed in a direction in which the pair of lower projected portions 502*b* and 502*c* approaches each other. In this state, the regulating member is moved toward the plate-like portion 230A of the front door 230 so that the pair of projections 234 enters the pair of engaging holes 505.

Simultaneously therewith, the projected portion 502*a* is pushed in between the pair of upper engaging portions 232*a* and 232*b*, and the base portion 501 is pushed in between the pair of lower engaging portions 233*a* and 233*b*. At this time, the pair of engaging portions 506 does not interfere with the pair of lower engaging portions 233*a* and 233*b* as shown in part (c) of FIG. 15. Then, after the regulating member 500 is pushed in as described above, when a force imparted to the pair of lower projected portions 502*b* and 502*c* is eliminated, the shape of the base portion 501 is elastically restored, so that the pair of engaging plate portions 506 enters the engaging grooves of the pair of lower engaging portions 233*a* and 233*b*, respectively.

As a result, as shown in parts (a) and (b) of FIG. 15, the regulating member 500 is mounted in the accommodating portion 231 so as not to be disconnected from the front door 230 and so as not to be rickety. That is, the pair of projections 234 enters the pair of engaging holes 505, so that the regulating member 500 is supported so as not to be disconnected from the accommodating portion 231 toward a lower portion of the front door 230. The pair of engaging plate portions 506 enters the engaging grooves of the pair of lower engaging portions 233*a* and 233*b*, respectively, so that the regulating member 500 is regulated so as not to be disconnected from the front door 230 toward the front side of the drawing sheet of parts (a) and (b) of FIG. 15. Further, the projected portion 502*a* is sandwiched between the pair of upper engaging portions 232*a* and 232*b*, and the base portion 501 is sandwiched between the pair of lower engaging portions 233*a* and 233*b*, so that a rickety state of the regulating member 500 is suppressed.

On the other hand, in the case that the regulating member 500 is demounted from the accommodating portion 231, as shown in part (c) of FIG. 15, the base portion 501 is elastically deformed in a direction in which the pair of lower projected portions 502*b* and 502*c* approaches each other. Then, the pair of engaging portions 506 is pulled out downwardly from the engaging holes of the pair of lower engaging portions 233*a* and 233*b*, so that engagement of the engaging holes with the pair of engaging portions 506 is eliminated. In this state, the regulating member is moved so as to be spaced from the plate-like portion 230A of the front door 230, so that the pair of projections 234 is pulled out of the pair of engaging holes 505. Simultaneously therewith, the projected portion 502*a* is pulled out from between the pair of upper engaging portions 232*a* and 232*b*, and the base portion 501 is pulled out from between the pair of lower engaging portions 233*a* and 233*b*. As a result, the regulating member 500 is demounted from the accommodating portion 231.

Thus, in this embodiment, as shown in part (a) of FIG. 15, when the accommodating container Ta is mounted in the first position which is a position during use thereof, the accommodating portion 231 capable of accommodating the regulating member 500 is provided on the front door 230. Incidentally, accommodation of the regulating member 500 may also be carried out by another constitution, such as fixing with screws, other than the above-described constitution in which the regulating member is flexed and engaged with the accommodating portion 231.

In this embodiment, even when the accommodating container Ta is accommodated in the accommodating portion 231 of the front door 230, as shown in FIG. 16, the regulating member 500 does not interfere with the grip portion 25 of the accommodating container Ta. That is, the front door 230 is formed so that in a closed state, the front door 230 can be disposed so as not to interfere with the grip portion 25 between the plate-like portion 230A on the front surface thereof and the grip portion 25 of the accommodating container Ta located in the first position.

Further, the accommodating portion 231 is formed so that the accommodated regulating member pushes the accommodating container Ta toward the downstream side with respect to the inserting direction (predetermined direction) when the front door 230 is closed in a state in which the accommodating container Ta is positioned downstream of the first position with respect to the inserting direction. Here, a clearance dimension G between the accommodating container Ta accommodated in the accommodating portion 231 of the front door 230 and the grip portion 25 of the accommodating container Ta is smaller than a pullable-in range in which the container pulling-in lever 403 pulls in the accommodating container Ta. That is, the clearance dimension G is smaller than a distance of movement of the accommodating container Ta from the time when the position of the pulling-in spring 404 exceeds the dead center until the one end of the accommodating container Ta abuts against the abutting portion 402*a* as shown in parts (b)-(d) of FIG. 7.

Accordingly, when the front door 230 in which the regulating member 500 is accommodated is closed, for example, in a state that the accommodating container Ta is inserted in a half-inserted state that the accommodating container Ta does not reach the second position, the regulating member 500 runs against the grip portion 25 and pushes the accommodating portion Ta to the pullable-in range. As a result, the accommodating container Ta is automatically pulled in to the first position by the container pulling-in lever 403. That is, in this embodiment, even in the case that the insertion of the accommodating container Ta is insufficient, the accommodating container Ta is automatically pulled in to the first position by closing the front door 230.

In this embodiment described above, it is possible to suppress exertion of the loads on the various devices connected between mounted the accommodating container Ta and the apparatus main assembly 200A during the transportation of the image forming apparatus 200. That is, in the case that the accommodating container Ta is transported by being packed with the apparatus main assembly 200A, the accommodating container Ta is mounted in the apparatus main assembly 200A in a state that the regulating member 500 is mounted to the grip 25 of the accommodating container Ta. As a result, the position of the accommodating container Ta is in a state of being regulated to the second position. As described above, in the second position, the discharge opening 21*a* and the opening 4*a* do not communicate with each other, so that the toner is not discharged from the accommodating container Ta. For this reason, it is possible to suppress leakage of the toner from the accommodating container Ta during the transportation of the image forming apparatus 200.

Particularly, at the second position, the sensor 406 does not contact the one end of the accommodating container Ta and the container-side contact 23 does not contact the main assembly-side contact 405, and further, the container driving gear 302 is not connected with the gear portion 20*a*. For this reason, it is possible to suppress exertion of the loads on the various devices such as the sensor 406, the container-side contact 23, the main assembly-side contact 405, the container driving gear 302, and the gear portion 20*a* due to vibration during the transportation of the image forming apparatus 200.

Further, in this embodiment, even after the regulating member 500 is demounted and the accommodating container Ta is mounted in the first position and then the image forming apparatus 200 is driven, the position of the accommodating container Ta is similarly regulated to the second position again, and as described above, the package transportation can be performed. That is, in the case that the package transportation can be performed after the apparatus is driven, the accommodating container Ta is moved to the second position, the regulating member 500 demounted from the accommodating portion 231 is mounted again to the grip 25 of the accommodating container Ta, so that the position of the accommodating container Ta can be regulated to the second position again.

Incidentally, in this embodiment, the constitution in which the container pulling-in device 410 was provided was described, but the image forming apparatus may also have a constitution in which the container pulling-in device 410 is not provided. In this case, for example, by employing a constitution in which the regulating member 500 is fixed to the inserting opening cover 210, an effect similar to the above described effect can be obtained.

Second Embodiment

Second Embodiment will be described using FIGS. 17 to 21. In the First Embodiment described above, the regulating member 500 was mounted to the grip 25 of the accommodating container Ta, so that the position of the accommodating container Ta was regulated to the second position. On the other hand, in this embodiment, the position of the accommodating container Ta is regulated to the second position by a container stopper 601 as a regulating means and a movable member. Other constitutions and functions are similar to those in the above-described First Embodiment, and therefore, similar constituent elements are represented by the same reference numerals or symbols and description and illustration thereof will be omitted or simplified. In the following, a portion different from the First Embodiment will be principally described.

Figure 17:
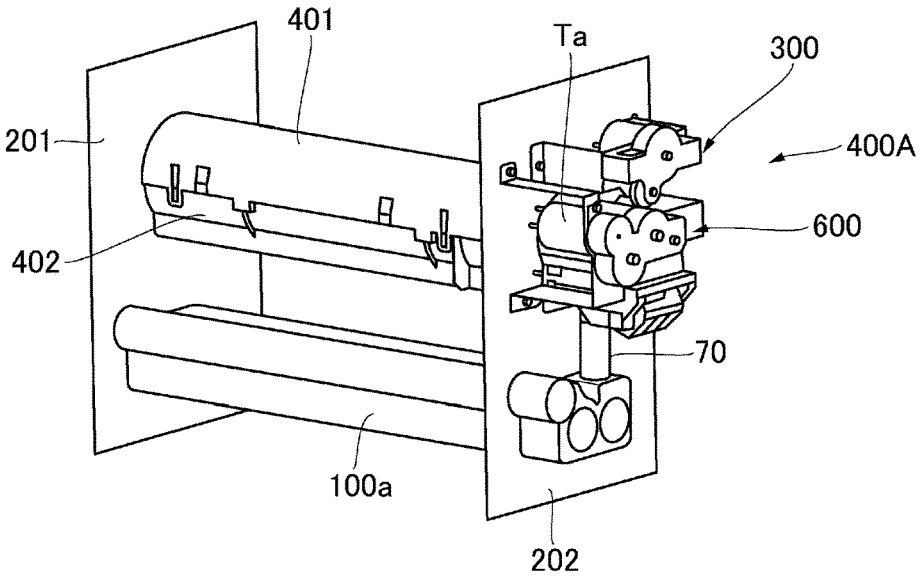
FIG. 17 is a perspective view illustrating a structure of the toner supplying portion according to the Embodiment 2.
Figure 18:
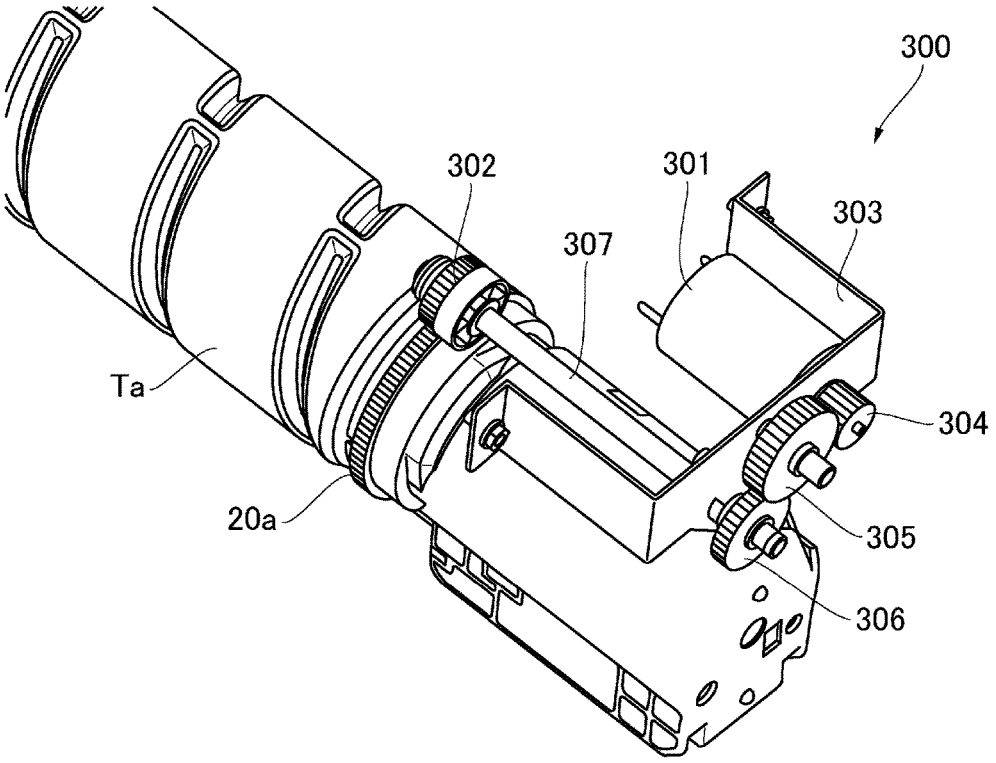
FIG. 18 is a perspective view illustrating a driving structure for the accommodating container according to Embodiment 2.

As shown in with reference to FIGS. 17 and 18, on the rear-side plate 202, a toner supplying portion 400A on the apparatus main assembly side where a supplying toner (toner for supply) is supplied from the accommodating container Ta to the developing device 100*a* is provided. Incidentally, constitutions of toner supplying portions for supplying toners from other accommodating containers Tb-Td to the developing devices 100*b*-100*d* are the same as the constitution of the toner supplying portion 400A for supplying the toner from the accommodating container Ta to the developing device 100*a*, and therefore will be omitted from description.

The toner supplying portion 400A includes a container driving device 300 and a supply pipe 70. Further, on the rear-side plate 202, a stopper unit 600 is mounted. The container driving device 300 and the supply pipe 70 have the same constitution as those in the First Embodiment and therefore will be omitted from detailed description. The stopper unit 600 for the accommodating container Ta is similar to those for the accommodating containers Tb-Td, and therefore, the stopper unit 600 for the accommodating container Ta will be described as a representative.

Figure 19:
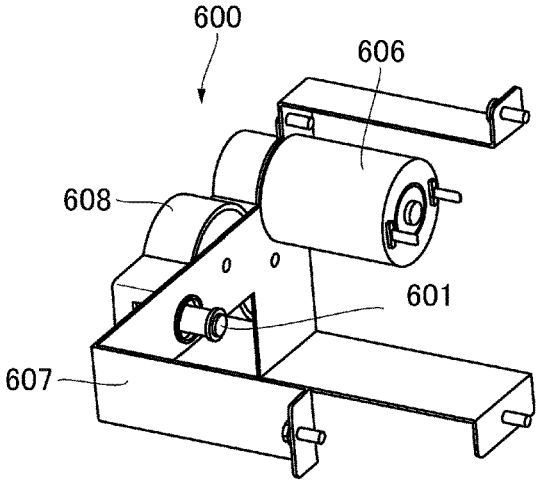
In FIG. 19, part (a) is a perspective view of the regulating device, and part (b) is a perspective view as viewed from the left side of part (a), and part (c) is an exploded perspective view of a container stopper and a slide gear in Embodiment 2.
Figure 19:
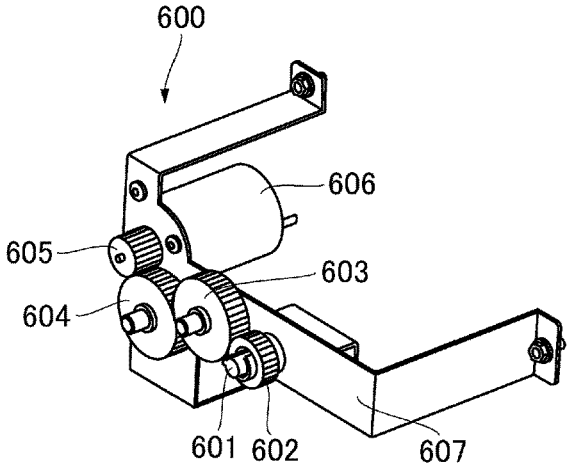
Figure 19:
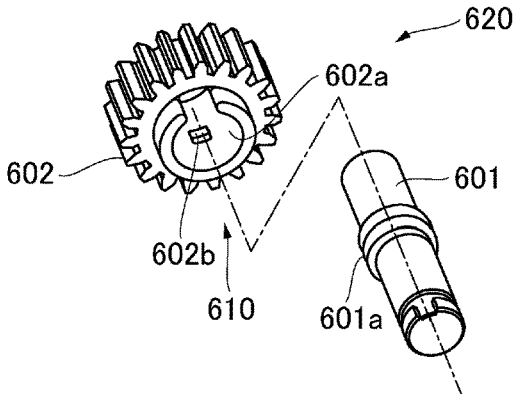

The stopper unit 600 includes, as shown in parts (a)-(c) of FIG. 19, the container stopper 601, a slide gear 602, idler gears 603 and 604, a pinion gear 605, a driving motor 606, a supporting plate 607, a cover 608, and the like. The container stopper 601 as the movable member is provided on a part (rear-side plate 202) of the apparatus main assembly so as to be movable relative to the accommodating container Ta. Further, as described later, at a first movement position, the container stopper 601 permits mounting of the accommodating container Ta in the first position, and at a second movement position different from the first movement position, the container stopper 601 regulates the position of the accommodating container Ta to the second position.

Such a container stopper 601 is moved from the second movement position to the first movement position by a movable member driving portion 620. The movable member driving portion 620 includes the slide gear 602 which is a rotatable member rotated by drive of the driving motor 606, and a converting portion 610 for converting rotation of the slide gear 602 to movement of the container stopper 601.

That is, as shown in part (b) of FIG. 19, between the driving motor 606 and the slide gear 602, the pinion gear 605 and the idler gears 603 and 604 are disposed. The slide gear 602 is rotated by transmitting drive of the driving motor 606 thereto through these gears 605, 604 and 603. The rotation of the slide gear 602 is converted to movement in a rectilinear direction by the converting portion 610, and then is transmitted to the container stopper 601. Incidentally, the respective gears 602-605 are, as shown in part (a) of FIG. 19, covered with the cover 608. In part (b) of FIG. 19, the cover 608 is omitted from illustration.

As shown in part (c) of FIG. 19, the slide gear 602 is rotatably supported around the container stopper 601, and the container stopper 601 is provided with a helical groove 601*a*, and the slide gear 602 is provided with a projection 602*a* engaging with the helical groove 601*a*. That is, the container stopper 601 is formed in a substantially cylindrical shape and includes the helical groove 601*a* formed helically along a circumferential direction at an intermediary portion with respect to a longitudinal direction. On the other hand, the slide gear 602 is provided with a through-hole 602*a* through which the container stopper 601 can pass, and is provided at a part of an inner peripheral surface of the through-hole 602*a* with the projection 602*b* projecting inwardly in a radial direction. Further, the container stopper 601 is inserted into the through-hole 602*a*, so that the projection 602*a* is engaged with the helical groove 601*a*. By the helical groove 601*a* and the projection 602*a*, the converting portion 610 is constituted.

The container stopper 601 is held by the supporting plate 607 and the cover 608 so as to be unrotatable and be movable in the longitudinal direction (rotational axis direction of the slide gear 602). On the other hand, the slide gear 602 is held by the supporting plate 607 so as to be unrotatable and be unmovable in the rotational axis direction. As a result, the slide gear 602 is rotated relative to the container stopper 601, so that on the basis of engagement between the helical groove 601*a* and the projection 602*b*, the container stopper 601 is slid (moved) relative to the slide gear 602 in the longitudinal direction. That is, the drive of the driving motor 606 is transmitted to the slide gear 602 through the pinion gear 605 and the idler gears 603 and 604, so that the slide gear 602 is rotated. Then, the rotation of the slide gear 602 is converted by converting portion 610 and is transmitted to the container stopper 601, so that the container stopper 601 is moved in the longitudinal direction.

In this embodiment, the container stopper 601 is moved from the second movement position to the first movement position by normal rotation of the driving motor 606, and is moved from the first movement position to the second movement position by reverse rotation of the driving motor 606. The driving motor 606, the respective gears 602-605, and the container stopper 601 are supported by the supporting plate 607, and the supporting plate 607 is fixed to the rear-side plate 202 on a rear side so that the container stopper 601 is oriented toward the front side. Further, the movement direction of the container stopper 601 is substantially parallel to the inserting direction of the accommodating container Ta to be inserted into the apparatus main assembly. Further, as shown in parts (a) and (b) of FIG. 20, an end surface of the container stopper 601 opposes an end surface of the accommodating container Ta with respect to the inserting direction.

Figure 20:
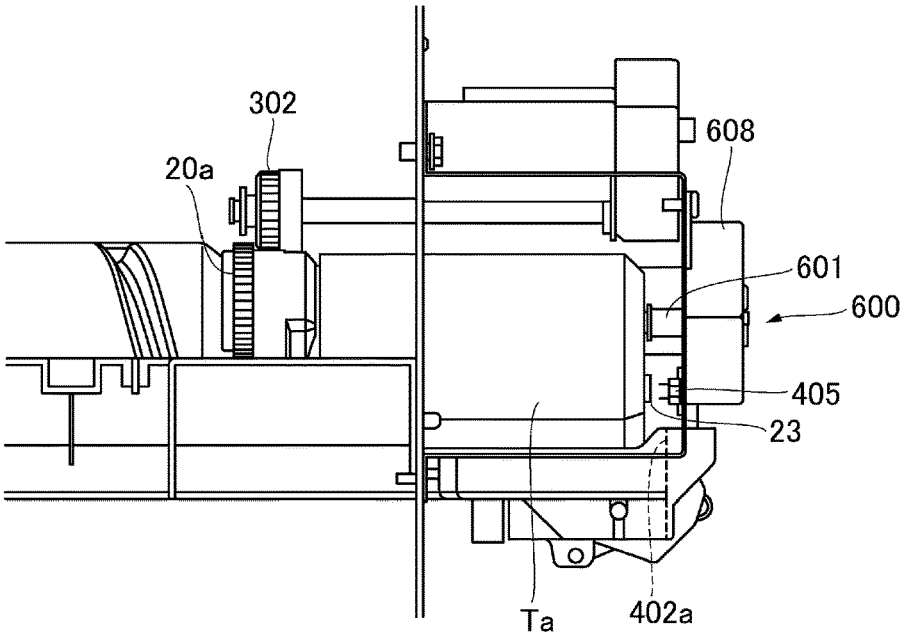
FIG. 20 is a side view showing a structure of a supplying portion in Embodiment 2, wherein part (a) shows a state in which the container stopper is in contact with the accommodating container, and part (b) shows a state in which the container stopper is retracted.
Figure 20:
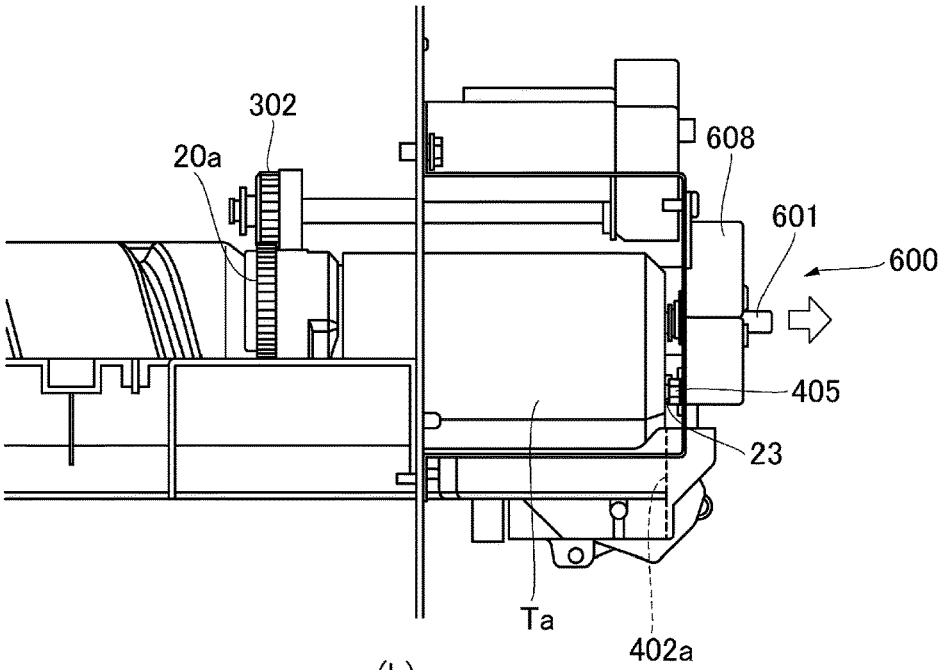

As shown in part (a) of FIG. 20, the container stopper 601 contacts the one end of the accommodating container Ta at the second movement position where the container stopper 601 projects toward the accommodating container Ta, and regulates the position of the container stopper 601 to the second position. On the other hand, as shown in part (b) of FIG. 20, the container stopper 601 does not contact the one end of the accommodating container Ta at the first movement position retracted from the accommodating container Ta than the second movement position is, and permits insertion of the accommodating container Ta to the first position. That is, the container stopper 601 is movable between a position (second movement position) where the container stopper 601 interferes with the accommodating container Ta during mounting of the accommodating container Ta into the apparatus main assembly and a position (first movement position) where the container stopper 601 does not interfere with the accommodating container Ta during mounting of the accommodating container Ta into the apparatus main assembly.

Specifically, as shown in part (a) of FIG. 20, the container stopper 601 is in the second movement position, the accommodating container Ta abuts against the container stopper 601 before it abuts against the abutting portion 402*a*. At this time, the container pulling-in lever 403 is positioned between the positions of parts (c) and (d) of FIG. 7, and a force in a direction in which the accommodating container Ta is mounted in the apparatus main assembly acts on the accommodating container Ta. For this reason, the accommodating container Ta in a state of being pulled in by the container pulling-in lever 403 is fixed in a state of abutting against the container stopper 601 located in the second movement position. In other words, the container stopper 601 regulates the position of the accommodating container Ta to the second position irrespective of the force for pulling-in the accommodating container Ta by the container pulling-in lever 403.

Figure 21:
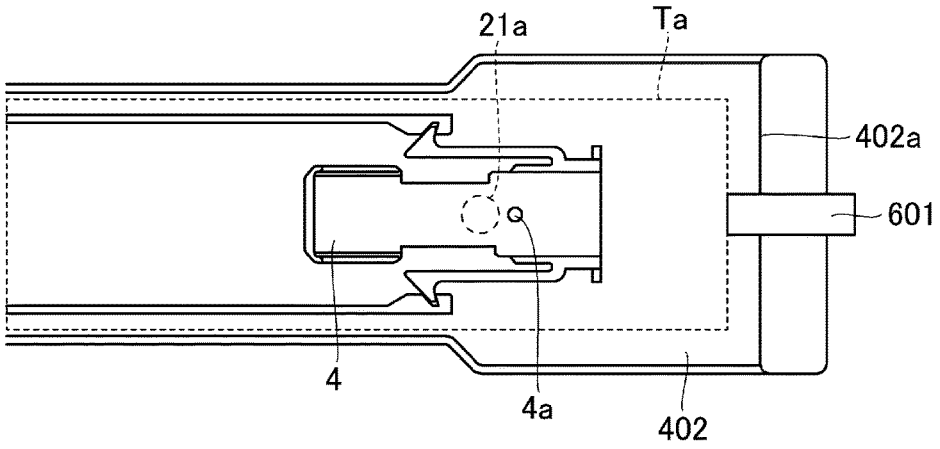
FIG. 21 is an illustration showing the positional relationship between the discharge opening of the accommodating container and the discharge opening of the shutter in a state where the accommodating container according to Embodiment 2 is packaged with the apparatus main body.

Further, in the state that the accommodating container Ta is positioned in the second position, the container-side contact 23 and the main assembly-side contact 405 also do not contact each other, and the container driving gear 302 does not engage with the gear portion 20*a*. Incidentally, as shown in part (b) of FIG. 13, the sensor 406 does not contact the one end of the accommodating container Ta. Further, in the state that the accommodating container Ta is positioned in the second position, a positional relationship between the discharge opening 21*a* of the flange portion 21 of the accommodating container Ta and the opening 4*a* of the shutter 4 is as shown in FIG. 21. That is, the discharge opening 21*a* and the opening 4*a* do not communicate with each other. For this reason, the toner is not discharged from the accommodating container Ta.

On the other hand, when the accommodating container Ta is mounted in the first position, the driving motor 606 is driven, so that the container stopper 601 is moved in a direction (rear side) in which the container stopper 601 is retracted from the accommodating container Ta. Then, the container stopper 601 is moved to the first movement position where the container stopper 601 does not interfere with the accommodating container Ta. As shown in part (b) of FIG. 20, the container stopper 601 is in the first movement position, the accommodating container Ta abuts against the abutting portion 402*a* and is mounted in the first position. At this time, the accommodating container Ta is pulled in by the container pulling-in lever 403 with retraction of the accommodating container Ta, and is automatically mounted in the first position.

When the accommodating container Ta is pulled in to the first position, as described above, the sensor 406 contacts the one end of the accommodating container Ta, so that the accommodating container Ta is detected by the sensor 406. Further, the container-side contact 23 contacts the main assembly-side contact 405, so that communication can be established between the accommodating container Ta and the apparatus main assembly. Further, the container driving gear 302 engages with the gear portion 20*a*, so that the drive can be transmitted from the container driving gear 302 to the gear portion 20*a*. Further, when the accommodating container Ta is mounted in the first position, as shown in part (b) of FIG. 9 described above, the discharge opening 21*a* of the flange portion 21 of the accommodating container Ta and the opening 4*a* communicate with each other, so that the toner can be discharged from the accommodating container Ta.

In this embodiment described above, it is possible to suppress exertion of the loads on the various devices connected between the mounted accommodating container Ta and the apparatus main assembly during the transportation of the image forming apparatus. That is, in the case that the accommodating container Ta is transported by being packed with the apparatus main assembly 200A, the accommodating container Ta is mounted in the apparatus main assembly 200A in a state that the container stopper 601 is moved to the second movement position. As a result, the position of the accommodating container Ta is in a state of being regulated to the second position. At the second position, the sensor 406 does not contact the one end of the accommodating container Ta and the container-side contact 23 does not contact the main assembly-side contact 405, and further, the container driving gear 302 is not connected with the gear portion 20*a*. For this reason, it is possible to suppress exertion of the loads on the various devices such as the sensor 406, the container-side contact 23, the main assembly-side contact 405, the container driving gear 302, and the gear portion 20*a* due to vibration during the transportation of the image forming apparatus.

Further, after installation of the image forming apparatus, the container stopper 601 is retracted from the second movement position to the first movement position, so that the accommodating container Ta is mountable in the first position which is a normal mounting position. As described above, the accommodating container Ta is pulled in to the first position by the container pulling-in lever 403 through retraction of the container stopper 601. Incidentally, even if there is no container pulling-in lever 403, when the container stopper 601 is retracted to the first movement position and the user pushes the accommodating container Ta, the accommodating container Ta is mountable in the first position.

Further, also in this embodiment, even after the accommodating container Ta is mounted in the first position and then the image forming apparatus is driven, the position of the accommodating container Ta is similarly regulated to the second position again, and as described above, the package transportation can be performed. That is, the driving motor 606 is reversely rotated, so that the container stopper 601 is moved to the first movement position. As a result, the position of the accommodating container Ta can be regulated to the second position again.

Incidentally, in this embodiment, a constitution in which the stopper unit 600 is provided, in a position opposing the accommodating container Ta, at a downstream end portion (the one end portion) with respect to the inserting direction of the accommodating container Ta and the container stopper 601 is expanded and contracted in the inserting direction of the accommodating container Ta was described. However, the container stopper 601 may only be required to have a constitution in which the container stopper 601 is capable of regulating the position of the accommodating container Ta to the second position and can permit movement of the accommodating container Ta to the first position. For this reason, for example, a container stopper may be provided at an upstream end portion or an intermediary portion with respect to the inserting direction of the accommodating container Ta so as to be projected and retracted in the radial direction of the accommodating container Ta, and the accommodating container Ta may be provided with a member which contacts the projected container stopper but which does not contact the retracted container stopper. Further, in the case that the container stopper contacts this member, the position of the accommodating container Ta is regulated to the second position, and in the case that the container stopper does not contact this member, the position of the accommodating container Ta is made movable to the second position.

Third Embodiment

Third Embodiment will be described using FIGS. 22 to 25. In the Second Embodiment described above, the container stopper 601 was moved by driving the driving motor 606. On the other hand, in this embodiment, drive for moving the container stopper 601 is carried out by the same driving source as drive of the accommodating container Ta. Other constitutions and functions are similar to those in the above-described Second Embodiment, and therefore, similar constituent elements are represented by the same reference numerals or symbols and description and illustration thereof will be omitted or simplified. In the following, a portion different from the Second Embodiment will be principally described.

Figure 22:
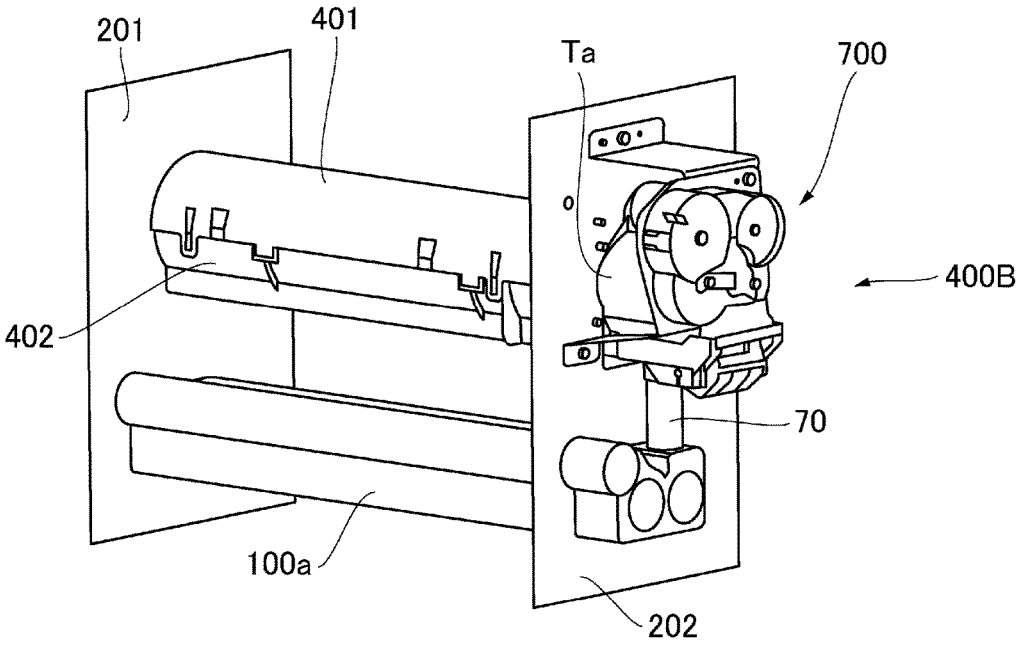
FIG. 22 is a perspective view showing the structure of the toner supplying portion according to Embodiment 3.

As shown in with reference to FIG. 22, on the rear-side plate 202, a toner supplying portion 400B on the apparatus main assembly side where a supplying toner (toner for supply) is supplied from the accommodating container Ta to the developing device 100*a* is provided. Incidentally, constitutions of toner supplying portions for supplying toners from other accommodating containers Tb-Td to the developing devices 100*b*-100*d* are the same as the constitution of the toner supplying portion 400B for supplying the toner from the accommodating container Ta to the developing device 100*a*, and therefore will be omitted from description.

The toner supplying portion 400B includes a driving device 700 and a supply pipe 70. A constitution in which the toner is supplied from the accommodating container Ta to the developing device 100*a* through the supply pipe 70 is the same constitution as the constitution in the Second Embodiment and therefore will be omitted from detailed description. The driving device 700 for the accommodating container Ta is similar to those for the accommodating containers Tb-Td, and therefore, the driving device 700 for the accommodating container Ta will be described as a representative.

Figure 23:
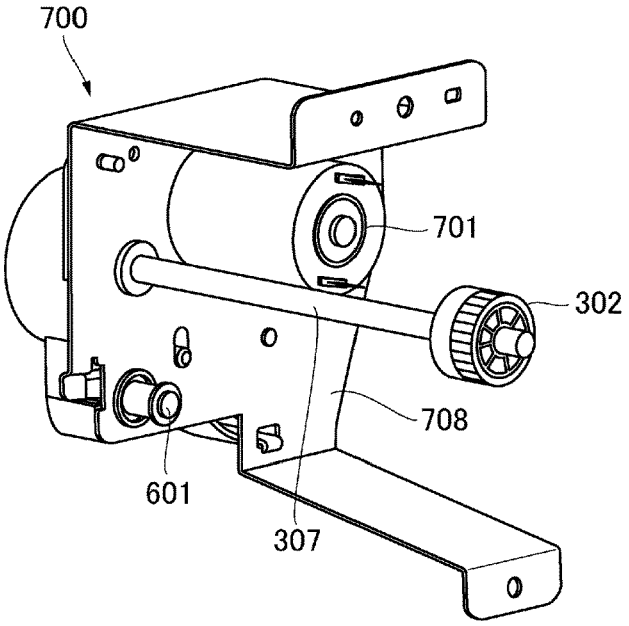
In FIG. 23, part (a) is a perspective view of a driving device, in Embodiment 3, and part (b) is a perspective view as seen from the left side of part (a).
Figure 23:
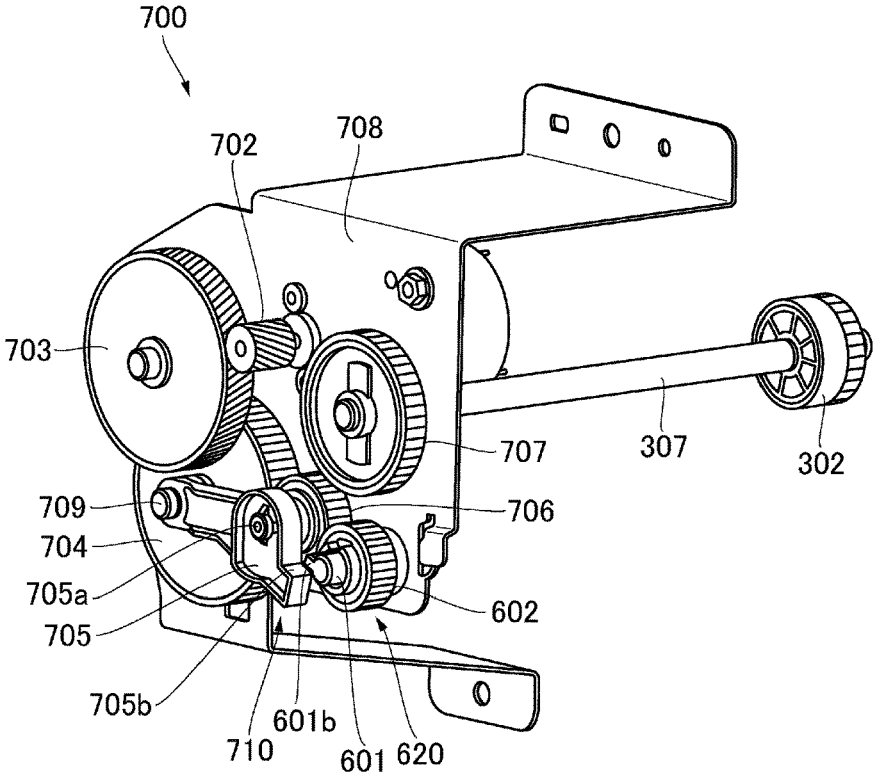

The driving device 700 includes, as shown in parts (a) and (b) of FIG. 23, a driving motor 701 as a driving source, a container driving gear 302, a gear portion 20*a* as a discharge driving portion (FIG. 5), a movable member driving portion 620, a container stopper 601 as a movable member, and the like. Further, the driving device 700 includes a pinion gear 702, an idler gear 703, a base gear 704, a pendulum link 705, a pendulum gear 706, a container drive transmission gear 707, a supporting plate 708, a rotation shaft 709, and the like. The movable member driving portion 620 includes, similarly as in the Second Embodiment, a slide gear 602 as a rotatable member and a converting portion 610 (part (c) of FIG. 19). In this embodiment, the slide gear 602 is rotation by drive of the driving motor 701.

Here, the driving motor 701 is the driving source capable of outputting drive for discharging the toner from the accommodating container Ta. That is, the drive of the driving motor 701 is, as described specifically later, transmitted to the container driving gear 302 through the pinion gear 702, the idler gear 703, the base gear 704, the pendulum gear 706, the container drive transmission gear 707, and a container driving shaft 307. The container driving gear 302 is, as shown in FIG. 5, connected with the gear portion 20*a* of the accommodating container Ta located in the first position. For this reason, the accommodating container Ta is rotated by the drive of the driving motor 701, so that as described above, the discharge of the toner is carried out.

In this embodiment, the container stopper 601 is moved from the second movement position to the first movement position by the drive of the driving motor 701 used in drive for discharging the toner. That is, in this embodiment, the driving source is common to movement of the container stopper 601 and discharge of the toner from the accommodating container Ta.

Incidentally, the container stopper 601 is, similarly as in the Second embodiment, provided on a part (rear-side plate 202) of the apparatus main assembly so as to be movable relative to the accommodating container Ta. Further, at a first movement position, the container stopper 601 permits mounting of the accommodating container Ta in the first position, and at a second movement position different from the first movement position, the container stopper 601 regulates the position of the accommodating container Ta to the second position. The container stopper 601 is moved from the second movement position to the first movement position by normal rotation of the driving motor 701, and is moved from the first movement position to the second movement position by reverse rotation of the driving motor 701.

Thus, in order to perform the movement of the container stopper 601 and the discharge of the toner by the drive of the driving motor 701, the drive of the driving motor 701 is switched by a switching portion 710. The switching portion 710 includes the pendulum link 705, the pendulum gear 706, a projection 705*b* and a regulating portion 601*b*. The pendulum link 705 is rotatably supported at a base end portion thereof by the rotation shaft 709 of the base gear 704.

The pendulum gear 706 is supported rotatably about a pendulum link shaft 705*a* at an end portion of the pendulum link 705. The pendulum gear 706 is disposed at a position where a tooth thereof engages with a tooth of the base gear 704. As a result, when the base gear 704 is rotated, the pendulum link 705 and the pendulum gear 706 are also rotated about the rotation shaft 709, and the pendulum gear 706 performs a rotational operation about a pendulum link shaft 705*a*.

The projection 705*b* is formed so as to project from the free end portion of the pendulum link 705 toward an end portion of the container stopper 601. The regulating portion 601*b* is provided at the end portion of the container stopper 601 and engages with the projection 705*b*, and thus regulates (limits) rotation of the pendulum link 705. The regulating portion 601*b* moves together with the container stopper 601 and engages with the projection 705*b* when the container stopper 601 is in the second movement position, and thus regulates (limits) rotation of the pendulum link 705. On the other hand, when the container stopper 601 is in the first movement position, engagement of the regulating portion 601*b* with the projection 705 is eliminated, so that the regulating portion 601 permits the rotation of the pendulum link 705.

Figure 24:
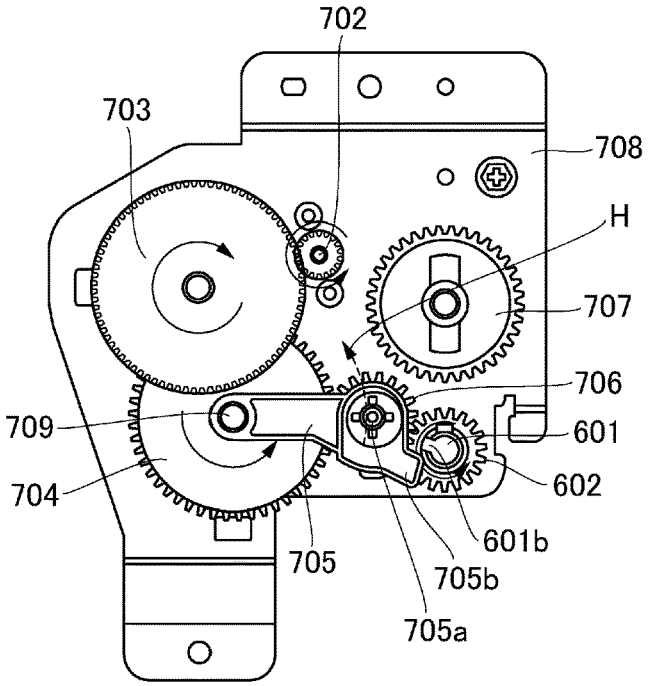
FIG. 24 is a side view of the driving device in Embodiment 3, in which part (a) shows a state in which drive is transmitted to the sliding gear, and part (b) shows a state in which driving is transmitted to the container drive transmission gear.
Figure 24:
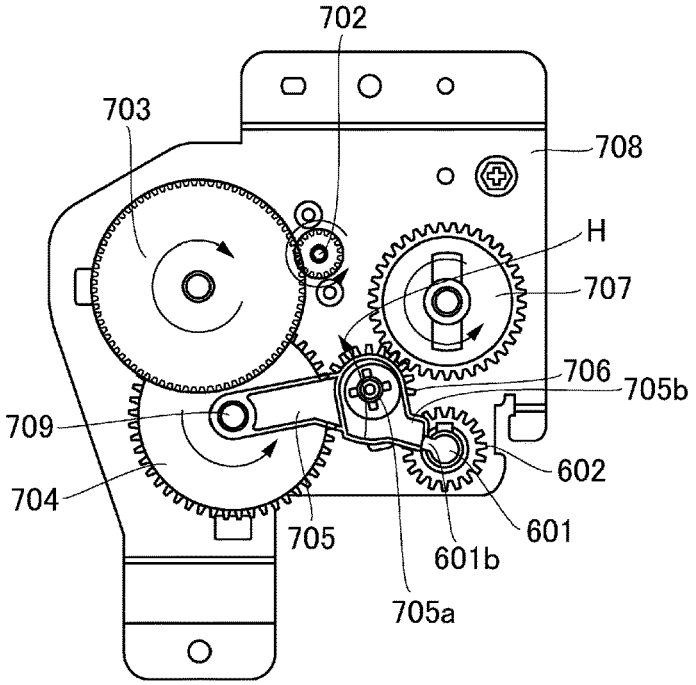

Part (a) of FIG. 24 shows a state that the container stopper 601 is in the second movement position where the container stopper 601 interferes with the accommodating container Ta, i.e., a position for regulating the mounting position of the accommodating container Ta during the package transportation to the second position. At this time, the pendulum gear 706 is in a positional relationship such that the pendulum gear 706 engages with the slide gear 602 but does not engage with the container drive transmission gear 707. In this state, when the driving motor 701 is rotated in order to mount the accommodating container Ta in the first position. Then, a rotational driving force in an arrow direction is applied to the pinion gear 702, the idler gear 703 and the base gear 704 by the driving motor 701, so that a force for moving the pendulum link 705 in an arrow H direction is applied to the pendulum link 705.

Figure 25:
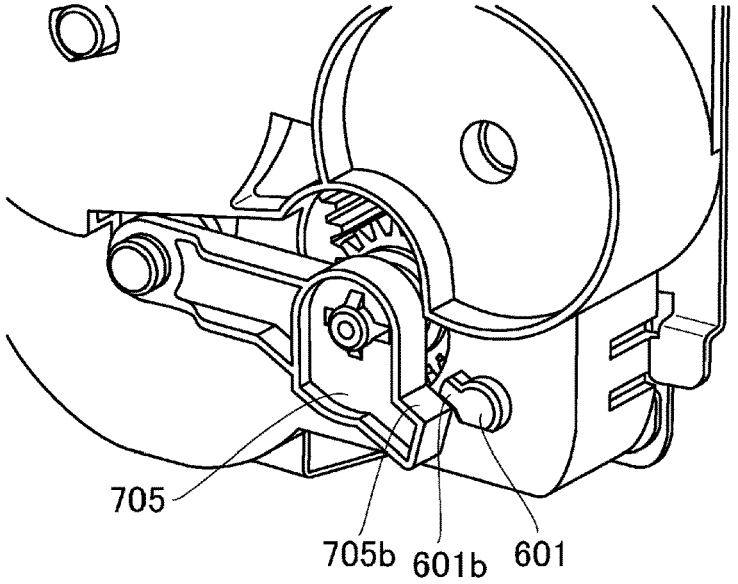
FIG. 25 is a perspective view of the driving device, in Embodiment 3, wherein part (a) shows a state in which drive is transmitted to the sliding gear, part (b) shows a state in which drive is transmitted to the container drive transmission gear.
Figure 25:
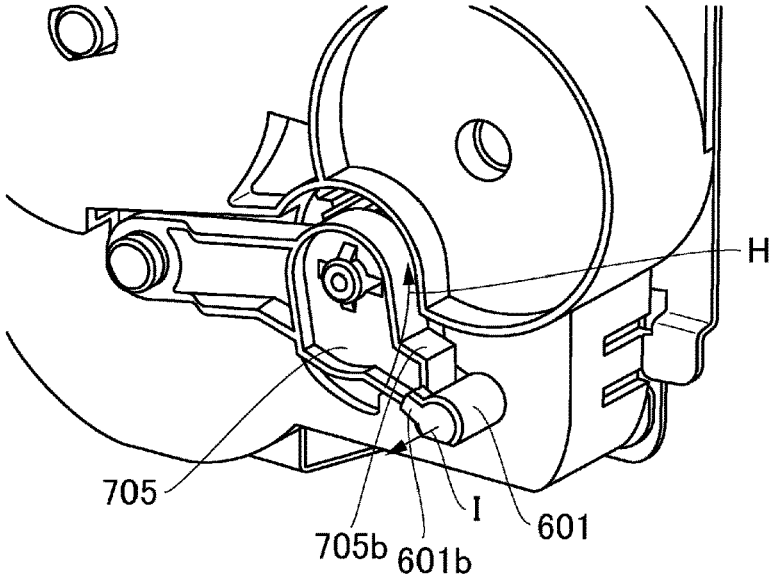

However, as shown in part (a) of FIG. 25, when the container stopper 601 is in the second movement position, the regulating portion 601*b* engages with the projection 705*b* of the pendulum link 705, so that the rotation of the pendulum link 705 in the arrow H direction is limited. For this reason, the pendulum gear 706 rotates about the pendulum link shaft 705*a* while being kept in the position of part (a) of FIG. 24. At this time, the pendulum gear 706 engages with the slide gear 602 and therefore transmits rotation (rotational force) to the slide gear 602 in engagement with the slide gear 602.

That is, in the case that the rotation of the pendulum link 705 is limited by the pendulum link 705, the rotational driving force of the driving motor 701 is transmitted only to the slide gear 602 through the pinion gear 702, the idler gear 703, the base gear 704, and the pendulum gear 706. When the slide gear 602 is rotationally driven, similarly as in the Second Embodiment, by engagement of the helical groove 601*a* and the projection 602*a*, the container stopper 601 is slid, so that the container stopper 601 is retracted from the second movement position, where the container stopper 601 interferes with the accommodating container Ta, to the first movement position.

At this time, as shown in part (b) of FIG. 25, the regulating portion 601*b* moves in an arrow I direction to a position where the regulating portion 601*b* does not engage with the projection 705*b* of the pendulum link 705, and permits the rotation of the pendulum link 705. To the pendulum link 705, a force for moving the pendulum link 705 in the arrow H direction is applied, and therefore, the pendulum link 705 and the pendulum gear 706 are rotated about the rotation shaft 709. Then, as shown in part (b) of FIG. 24, the pendulum gear 706 moves to an engaging position with the container drive transmission gear 707.

That is, the rotational driving force of the driving motor 701 is transmitted only to the container drive transmission gear 707 through the pinion gear 702, the idler gear 703, the base gear 704, and the pendulum gear 706. Rotation of the container drive transmission gear 707 is transmitted to the container driving gear 302 through the container driving shaft 307. The container driving gear 302 is, as shown in FIG. 5, connected with the gear portion 20*a* of the accommodating container Ta located in the first position, and therefore, the accommodating container Ta is rotated by the drive of the driving motor 701, so that as described above, the discharge of the toner is carried out.

On the other hand, in the case that the container stopper 601 is moved to the second movement position again, the driving motor 701 is reversely rotated. Then, the pendulum link 705 is rotated from the position of part (b) of FIG. 24 in a direction opposite to the arrow H direction and in the state of part (a) of FIG. 25. At this time, the pendulum gear 706 engages with the slide gear 602, so that the rotation of the pendulum link 705 is limited. Then, to the slide gear 602, rotation in a direction opposite to the arrow direction of part (a) of FIG. 24 is transmitted, and the container stopper 601 is moved in a direction opposite to the arrow I direction part (b) of FIG. 25, and in the state of part (a) of FIG. 25. In this state, the container stopper 601 is in the second movement position, and the regulating portion 601*b* engages with the projection 705*b* of the pendulum link 705.

Also in this embodiment, the accommodating container Ta is mounted in the apparatus main assembly 200A in a state that the container stopper 601 is moved to the second movement position. As a result, the position of the accommodating container Ta is in a state of being regulated to the second position, so that it is possible to suppress exertion of the loads on the various devices connected between the mounted accommodating container Ta and the apparatus main assembly during the transportation of the image forming apparatus.

Further, after installation of the image forming apparatus, the container stopper 601 is retracted from the second movement position to the first movement position, so that the accommodating container Ta is mountable in the first position which is a normal mounting position. That is, the driving motor 701 is normally rotated, so that the container stopper 601 is moved to the first movement position as described above. At this time, similarly as in the Second Embodiment, the accommodating container Ta is pulled in to the first position by the container pulling-in lever 403 (parts (a)-(d) of FIG. 7) through retraction of the container stopper 601. The driving motor 701 is normally rotated, so that a rotational driving force of the driving motor 701 is transmitted to the accommodating container Ta and discharge of the toner from the accommodating container Ta can be carried out.

That is, in this embodiment, by using only the normal rotation of the driving motor 701, the sliding (movement) of the container stopper 601 and the rotational drive of the container driving gear 302 are sequentially carried out. As a result, the drive is carried out after the accommodating container Ta is moved to the first position which is a normal mounting position, so that the drive can be started after the gear portion 20*a* and the container driving gear 302 are engaged with each other. Further, by reversely rotating the driving motor 701, the container stopper 601 can also be returned to the second movement position where the container stopper 601 interferes with the accommodating container Ta.

In this embodiment, the rotational drive of the toner accommodating container Ta and the drive of the container stopper 601 for regulating the position of the toner accommodating container Ta to the second position during package transportation can be carried out by the same driving source. For this reason, cost reduction can be realized compared with the Second Embodiment.

Fourth Embodiment

Next, using FIGS. 26-29, the Fourth Embodiment when the toner accommodating container T is transported in a state that the toner accommodating container T is mounted in and packed with the apparatus main assembly 200, which state is a characteristic feature of the present invention will be described.

Parts (a) and (b) of FIG. 26 are perspective views for illustrating a state that the regulating member 500 is mounted on the toner accommodating container T when the toner accommodating container T is transported in the mounted and packed state.

As an outline, the regulating member 500 is mounted on a cover member 28 provided on a discharge side of each of the toner accommodating containers Ta-Td for the respective colors and in a state that the regulating member 500 is sandwiched between the cover member 28 and the abutting portion 402*a*, the toner accommodating container T is transported in the mounted and packed state.

As shown in parts (a) and (b) of FIG. 26, the cover member 28 and the regulating member 500 are positioned relative to each other by engagement of locking holes 28*b* of the cover member 28 and locking claws 512 of the regulating member 500 with each other.

As shown in parts (a)-(c) of FIG. 29, the locking claws 512 are flexed in a process of locking the regulating member 500 to the cover member 28, and when the locking claws 512 are pushed in to a rear side, flexure of the locking claws 512 is returned to an original state, and thus the regulating member 500 is fixed to the cover member 28.

A positional relationship between the toner accommodating container T and related component parts when the toner accommodating container T is transported in the mounted and packed state will be described using parts (a) and (b) of FIG. 27.

Part (a) of FIG. 27 is a sectional view showing a state on a discharge side that the regulating member 500 is mounted on the toner accommodating container T. Part (b) of FIG. 27 is a schematic view showing a positional relationship between the toner accommodating container T and the shutter 4 on the lower container holding guide 402 when the regulating member 500 is mounted on the toner accommodating container T. As shown in parts (a) and (b) of FIG. 27, when the regulating member 500 is fixed to the cover member 28, the regulating member 500 abuts against the abutting portion 402*a*, so that the toner accommodating container T is maintained so as not to move toward a rear side in a distance exceeding a certain amount.

In this state, the container pulling-in lever 403 is in a position between those of parts (c) and (d) of FIG. 6, and a force in a direction in which the toner accommodating container T is mounted in the apparatus main assembly acts on the toner accommodating container T, so that by the container pulling-in lever 403, the toner accommodating container T is fixed in a regulated state to the abutting portion 402*b* through the regulating member 500 is mounted on the cover member 28.

Further, as shown in part (b) of FIG. 27, at positions of the discharge opening 21*a* of the flange 21 of the toner accommodating container T and the discharge opening 4*a* of the shutter 4, as shown in part (b) of FIG. 27, the discharge opening 21*a* and the discharge opening 4*a* do not communicate with each other, and therefore, the toner is not discharged from the toner accommodating container T.

As in a constitution of this embodiment, when the regulating member 500 is mounted on the one end of the toner accommodating container T, the force of the container pulling-in lever 403 and a force for extending the toner accommodating container T are not exerted, and therefore, the toner accommodating container T is prevented from being deformed due to standing thereof for a long term.

Also at positions of the discharge opening 21*a* of the flange 21 and the discharge opening 4*a* of the shutter 4, these positions are not influenced by a full length of the toner accommodating container T, so that the positional relationship can be ensured with high accuracy.

FIG. 28 is a side view showing a positional relationship between the front door 230 and the toner accommodating container T when the regulating member 500 is mounted on the toner accommodating container T.

As shown in FIG. 28, similarly as in the First Embodiment, a space is provided so that the front door 230 can be closed even in a state that the regulating member 500 is mounted on the toner accommodating container T.

In the above-described constitution, when the apparatus main assembly is transported, the toner accommodating container T is mounted in the apparatus main assembly in a state that the regulating member 500 is mounted on the cover member 28 of the toner accommodating container T, so that the toner accommodating container T can be mounted in and packed with the apparatus main assembly with no leakage of the toner from the toner accommodating container T. In the case that the toner accommodating container T is in a first mounting position for toner supply, when the locking claws 512 are lightly pinched, the regulating member 500 can be easily demounted. Further, also after the operation of the apparatus main assembly, the regulating member 500 is mounted on the toner accommodating container T, so that the toner accommodating container T can be returned to a state that the toner accommodating container T is transported in the mounted and packed state.

Fifth Embodiment

Next, using FIG. 30, the Fifth Embodiment when the toner accommodating container T is transported in a state that the toner accommodating container T is mounted in and packed with the apparatus main assembly 200, which state is a characteristic feature of the present invention will be described. In the Fourth Embodiment, a constitution in which by engaging the locking holes 28*b* with the locking claws 512 provided on the regulating member 500, the regulating member 500 fixed to the cover member 28 was employed. On the other hand, in this embodiment, a fixing method is characterized in that a detachably mountable adhesive tape (seal) 600 is used without using the locking claws. Other portions, such as features of the regulating member 500 are similar to those of the Fourth Embodiment.

Specifically, the adhesive tape 600 is used for fixing the regulating member 500 to the cover member 28. The toner accommodating container T is provided in the image forming apparatus in a state that the regulating member 500 is fixed to the cover member 28 by the adhesive tape 600. Further, in the case that the toner supply is carried out, the adhesive tape 600 is peeled off of the toner accommodating container T, so that the regulating member 500 can be demounted from the cover member 28, and therefore, the toner accommodating container T may only be required to be mounted in in the image forming apparatus again after the adhesive tape 600 is removed.

In the above-described constitution, when the apparatus main assembly is transported, the toner accommodating container T is mounted in the apparatus main assembly in a state that the regulating member 500 is mounted on the cover member 28 of the toner accommodating container T, so that the toner accommodating container T can be mounted in and packed with the apparatus main assembly with no leakage of the toner from the toner accommodating container T.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-163430 filed on Aug. 28, 2017, which is hereby incorporated by reference herein in its entirety.

What is claimed is:

1. An image forming apparatus comprising:

a developer container configured to contain a developer, said developer container including a discharge portion for discharging the developer;

a receiving portion configured to receive the developer discharged from said discharge portion;

a mounting portion configured to mount said developer container at a first position where the developer is supplied to said receiving portion from said discharge portion;

a cover capable of opening and closing;

an inserting portion inserted with said developer container to mount said developer container to said mounting portion; and a regulating member attachably and detachably provided on said developer container, said regulating member being configured to regulate a relative position of said developer container to said mounting portion to that said developer container is confined at a second position which is upstream of the first position with respect to an inserting direction of said developer container inserted into said inserting portion and where the developer is not supplied to said receiving portion from said discharge portion, wherein in a state that said regulating member is not attached to said developer container, and said developer container is mounted at the first position, said cover is capable of closing said inserting portion, and in a state that said regulating member is attached to said developer container, and said developer container is confined at the second position, said cover is capable of closing the inserting portion.

2. An image forming apparatus according to claim 1, wherein said developer container includes a shutter for opening and closing said discharge portion, and wherein in a state that said developer container is mounted at the first position, said shutter takes a position for opening said discharge portion, and in a state that said developer container is confined at the second position, said shutter takes a position for closing said discharge portion.

3. An image forming apparatus according to claim 1, wherein said mounting portion includes a detector capable of contacting said developer container to detect presence of said developer container, and said detector contacts said developer container in a state that said developer container mounted at the first position, and said detector does not contact said developer container in a state that said developer container is confined at the second position.

4. An image forming apparatus according to claim 1, wherein said developer container includes a first contact, and said mounting portion includes a second contact which contacts said first contact in a state that said developer container is mounted at the first position and which does not contact said first contact in a state that said developer container is confined at the second position.

5. An image forming apparatus according to claim 1, wherein said mounting portion includes a pulling portion engageable with a part of said developer container during an inserting operation of said developer container into said mounting portion to pull said developer container to the first position, and said regulating member is capable of keeping said developer container at the second position irrespective of a pulling force applied to said developer container by said pulling portion, and wherein said pulling portion pulls said developer container to the first position upon release from said regulating member at the second position.

6. An image forming apparatus according to claim 1, further comprising a driving source, a discharging driving portion configured to receive a driving force from said driving source, and a drive transmitting portion configured to transmit a driving force from said driving source to said discharging driving portion in a state that said developer container is mounted at the first position and configured not to transmit the driving force to said discharging driving portion in a state that said developer container is confined at the second position.

7. An image forming apparatus according to claim 1, wherein said mounting portion is capable of mounting said developer container at the first position by inserting said developer container in the inserting direction, and said mounting portion includes a contact portion at a portion where an upstream end portion of said developer container with respect to the inserting direction in a state that said developer container is mounted at the first position, and said developer container includes an attaching portion where said regulating member is attachable, at the upstream end portion, and wherein said regulating member contacts said contact portion in a state of being attached to said attaching portion so that a position of said developer container at the second position is upstream of the first position with respect the inserting direction.

8. An image forming apparatus according to claim 7, wherein said cover is provided with an accommodating portion capable of accommodating said regulating member removed from said attaching portion, and said accommodating portion does not interfere with said regulating member accommodated in said accommodating portion, in a state that said cover closes the inserting position and said developer container is mounted at the first position.

9. An image forming apparatus according to claim 8, wherein said accommodating portion is configured so that in a state that said cover is closed with said developer container being disposed at a position upstream of the first position with respect to the inserting direction, said regulating member accommodated in said accommodating portion pushes said developer container downstream with respect to the inserting direction.

10. An image forming apparatus according to claim 1, wherein in a state that said regulating member is attached to said developer container, said regulating member is provided at an upstream end portion of said developer container with respect to the inserting direction.

11. An image forming apparatus according to claim 1, wherein said regulating member is fixed on said developer container by mutually engaging an engaging portion provided on one of said regulating member and said developer container and an engaged portion provided on the other of said regulating member and said developer container.

12. An image forming apparatus according to claim 11, wherein said engaging portion includes a locking claw provided on said regulating member, and said engaged portion includes a locking hole provided on said developing container.

13. An image forming apparatus according to claim 1, wherein said regulating member is fixed on said developer container by a seal.

14. An image forming apparatus according to claim 1, wherein in a state that said developer container is mounted at the first position, the discharge portion communicates with said receiving portion, and in a state that said developer container is confined at the second position, the discharge portion does not communicate with said receiving portion.

15. An image forming apparatus according to claim 1, wherein in a state that said regulating member is attached to said developing container, said regulating member is provided at a downstream end portion of said developer container with respect to the inserting direction.

16. An image forming apparatus comprising:

a developer container configured to contain a developer, said developer container including a discharge portion for discharging the developer;

a receiving portion configured to receive the developer discharge from said discharge portion;

a mounting portion configured to mount said developer container at a first position where the developer is supplied to said receiving portion from said discharge portion;

a cover capable of opening and closing;

an inserting portion inserted with said developer container to mount said developer container to said mounting portion;

a regulating member attachably and detachably provided on said developer container, said regulating member being configured to regulate a relative position of said developer container to said mounting portion so that said developer container is confined at a second position which is upstream of the first position with respect to an inserting direction of said developer container inserted into said inserting portion and where the developer is not supplied to said receiving portion from said discharge portion; and a retracting mechanism configured to retract said regulating member, wherein in a state that said regulating member is not attached to said developer container and said developer container is mounted at the first position, said cover is capable of closing said inserting portion, and in a state that said regulating member is attached to said developer container and said developer container is confined at the second position, said cover is capable of closing said inserting portion.

17. An image forming apparatus according to claim 16, wherein said developer container includes a shutter for opening and closing said discharge portion, and wherein in a state that said developer container is mounted at the first position, said shutter takes a position for opening said discharge portion, and in a state that said developer container is confined at the second position, said shutter takes a position for closing said discharge portion.

18. An image forming apparatus according to claim 16, wherein said mounting portion includes a detector capable of contacting said developer container to detect presence of said developer container, and said detector contacts said developer container in a state that said developer container is mounted at the first position, and said detector does not contact said developer container in a state that said developer container is confined at the second position.

19. An image forming apparatus according to claim 16, wherein said developer container includes a first contact, and said mounting portion includes a second contact which contacts said first contact in a state that said developer container is mounted at the first position and which does not contact said first contact in a in a state that said developer container is confined at the second position.

20. An image forming apparatus according to claim 16, wherein said mounting portion includes a pulling portion engageable with a part of said developer container during an inserting operation of said developer container into said mounting portion to pull said developer container to the first position, and said regulating member is capable of keeping said developer container at the second position irrespective of a pulling force applied to said developer container by said pulling portion, and wherein said pulling portion pulls said developer container to the first position upon release from said regulating member at the second position.

21. An image forming apparatus according to claim 16, further comprising a driving source, a discharging driving portion configured to receive a driving force from said driving source, and a drive transmitting portion configured to transmit a driving force from said driving source to said discharging driving portion in a state that said developer container is mounted at the first position and configured not to transmit the driving force to said discharging driving portion in a state that said developer container is confined at the second position.

22. An image forming apparatus according to claim 16, wherein said retracting mechanism includes a rotatable member capable of being driven by a motor, a converting portion configured to convert the rotation of said rotatable member to a movement of said rotatable member, wherein said rotatable member is moved to the retracted position from the regulating position by a forward rotation of said motor and is moved to the regulating position from the retracted position by a backward rotation of said motor.

23. An image forming apparatus according to claim 22, further comprising a driving source capable of outputting a driving force for discharging the developer from said developer container, wherein said regulating member includes a movable member provided on a main assembly so as to be movable relative to said developer container, and wherein said developer container is capable of being mounted at the first position in a case where said regulating member takes the retracted position, and said developer container is confined at the second position in a case where said regulating member takes the regulating position, and wherein said movable member is movable from the regulating position to the retracted position by actuating said driving source.

24. An image forming apparatus according to claim 16, wherein in a state that said developer container is mounted at the first position, said discharge portion communicates with said receiving portion, and in a state that said developer is confined at the second position, the discharge portion does not communicate with said receiving portion.

* * * * *